US012098517B2

(12) United States Patent
Mulligan et al.

(10) Patent No.: US 12,098,517 B2
(45) Date of Patent: Sep. 24, 2024

(54) WORK MACHINE WITH AUTOMATIC PITCH CONTROL OF IMPLEMENT

(71) Applicant: DEERE & COMPANY, Moline, IL (US)

(72) Inventors: Patrick J. Mulligan, Epworth, IA (US); Giovanni A. Wuisan, Dubuque, IA (US); Michael R. Tigges, Dubuque, IA (US); Ryan R. Neilson, Dubuque, IA (US); Nathan J. Horstman, Durango, IA (US); Cory J. Brant, Hazel Green, WI (US); Timothy M. Post, Potosi, WI (US); Prasad Nigdikar, Pune (IN); Antony R. Maria, Thoothukudi (IN)

(73) Assignee: DEERE & COMPANY, Moline, IL (US)

( * ) Notice: Subject to any disclaimer, the term of this patent is extended or adjusted under 35 U.S.C. 154(b) by 783 days.

(21) Appl. No.: 17/161,990

(22) Filed: Jan. 29, 2021

(65) Prior Publication Data

US 2022/0090350 A1 Mar. 24, 2022

Related U.S. Application Data

(63) Continuation-in-part of application No. 17/028,107, filed on Sep. 22, 2020, now Pat. No. 11,926,988.

(51) Int. Cl.

| | |
|---|---|
| ***E02F 3/815*** | (2006.01) |
| ***E01H 5/06*** | (2006.01) |
| ***E02F 3/76*** | (2006.01) |

(52) U.S. Cl.

CPC ..... *E02F 3/8155* (2013.01); *E01H 5/065* (2013.01); *E02F 3/7627* (2013.01)

(58) Field of Classification Search

CPC ..... E02F 3/8155; E02F 3/844; E02F 3/7613; E02F 3/7627; E02F 3/815; E01H 5/065

See application file for complete search history.

(56) References Cited

U.S. PATENT DOCUMENTS

| | | | |
|---|---|---|---|
| 3,157,099 | A | 11/1964 | Ulrich |
| 4,099,578 | A | 7/1978 | Stevens |

(Continued)

FOREIGN PATENT DOCUMENTS

| | | | |
|---|---|---|---|
| DE | 102021208926 | A1 | 3/2022 |
| EP | 3521515 | A1 | 8/2019 |

OTHER PUBLICATIONS https://www.meiren.ee/en/snow-plows/snow-plow-vles-for=wheel-loader/; "W-snowplow VLES for wheel loader | Meiren snow plows"; pp. 1-7; Date Sep. 22, 2020.

(Continued)

*Primary Examiner* — Thomas B Will
*Assistant Examiner* — Joel F. Mitchell
(74) *Attorney, Agent, or Firm* — Taft Stettinius & Hollister LLP; Stephen F. Rost

(57) ABSTRACT

A blade for a work machine includes a body having a main portion including a top edge, a bottom edge, a first lateral edge and a second lateral edge. A wing portion is pivotally coupled to the body about a pivot axis. The first lateral edge includes a curved edge extending outwardly towards the wing portion, where the curved edge forms an apex between the top edge and the bottom edge. A first axis is defined through a first intersection point and a second intersection point, the first intersection point located at an intersection of the top edge and the first lateral edge and the second intersection point located at an intersection of the bottom edge and the first lateral edge. A second axis is defined through the apex and is parallel to the first axis. The pivot axis is located between the first axis and the second axis.

19 Claims, 14 Drawing Sheets

(56) References Cited

U.S. PATENT DOCUMENTS

| | | | | |
|---|---|---|---|---|
| 4,135,583 | A | 1/1979 | Becker | |
| 5,848,654 | A * | 12/1998 | Belcher, Jr. | E02F 3/815 37/274 |
| 5,860,230 | A * | 1/1999 | Daniels | E01H 5/06 37/231 |
| 6,425,196 | B1 | 7/2002 | Weagley et al. | |
| 6,442,877 | B1 | 9/2002 | Quenzi et al. | |
| 7,681,337 | B2 * | 3/2010 | Watson | E01H 5/065 37/274 |
| 7,918,042 | B2 * | 4/2011 | Ropog | E01H 5/066 37/281 |
| 8,127,471 | B2 * | 3/2012 | Stevens et al. | E01H 5/066 37/274 |
| 8,919,455 | B2 | 12/2014 | Hendron et al. | |
| 9,068,324 | B2 * | 6/2015 | Linder et al. | E02F 3/8155 |
| 9,151,006 | B2 | 10/2015 | Guggino et al. | |
| 9,200,418 | B2 * | 12/2015 | Jones et al. | E05D 3/02 |
| 9,388,544 | B2 * | 7/2016 | Reeves et al. | E01H 10/007 |
| 9,624,643 | B2 | 4/2017 | Hendron et al. | |
| 10,011,972 | B2 * | 7/2018 | Helmeczi et al. | E02F 3/8155 |
| 10,132,050 | B1 | 11/2018 | Mandan | |
| 2012/0059554 | A1 | 3/2012 | Omelchenko et al. | |
| 2016/0230367 | A1 | 8/2016 | Hendron et al. | |
| 2016/0312421 | A1 | 10/2016 | Ummenhofer et al. | |
| 2017/0107700 | A1 | 4/2017 | Faivre et al. | |
| 2017/0218597 | A1 | 8/2017 | Holman | |

OTHER PUBLICATIONS http://www.domorequipment.com/r600c/; "R600C Mechanical Aggregate Spreader by DoMor"; pp. 1-5; Date: Sep. 22, 2020.

www.cat.com; 2015 Caterpillar; "Cat D6N Track-Type Tractor"; pp. 1-2.

Komatsu Ltd; Article "Bulldozers D61EX/PX-12"; pp. 1-12.

https://www.pistenbully.com/aut/en/vehicles/all-vehicles.html; "Snow Groomers"; Date: Sep. 22, 2020; pp. 1-18.

* cited by examiner

WORK MACHINE WITH AUTOMATIC PITCH CONTROL OF IMPLEMENT

RELATED APPLICATIONS

This application is a continuation-in-part of U.S. patent application Ser. No. 17/028,107, filed Sep. 22, 2020 and entitled "Work Machine with Automatic Pitch Control of Implement," the disclosure of which is hereby incorporated by reference in its entirety.

FIELD OF THE DISCLOSURE

The present disclosure generally relates to a work machine having actuators to adjust an implement, and more particularly to a work vehicle having a control system and method to adjust a pitch of the implement.

BACKGROUND

Work vehicles are configured to perform a wide variety of tasks including use as construction vehicles, forestry vehicles, lawn maintenance vehicles, as well as on-road vehicles such as those used to plow snow, spread salt, or vehicles with towing capability. Additionally, work vehicles typically perform work with one or more implements that are moved by actuators in response to commands provided by a user of the work vehicle, or by commands that are generated automatically by a control system, either located within the vehicle or located externally to the vehicle.

In one example such as a bulldozer, the bulldozer is equipped with an implement, such as a blade, which is moved by actuators responsive to implement commands. The blade is used to move materials. To accomplish these tasks, the position of the blade is adjusted by one or more actuators. On a utility crawler dozer for instance, the blade is typically adjustable in different directions, which includes raising and lowering of the blade, adjusting a pitch position of the blade by moving the top portion of the blade forward and backward relative to a lower pivot point, an angle of the blade by moving one or the other end of the blade left or right about a center pivot point, and a tilt of the blade about a center pivot point to raise or lower one side of the blade or the other.

Other work vehicles include, but are not limited to, excavators, loaders, and motor graders. In motor graders, for instance, a drawbar assembly is attached toward the front of the grader, which is pulled by the grader as the grader moves forward. The drawbar assembly rotatably supports a circle drive member at a free end of the drawbar assembly and the circle drive member supports a work implement such as the blade, also known as a mold board. The angle of the work implement beneath the drawbar assembly can be adjusted by the rotation of the circle drive member relative to the drawbar assembly.

In addition, to the blade being rotated about a rotational fixed axis, the blade is also adjustable to a selected angle with respect to the circle drive member. This angle is known as blade slope. The elevation of the blade is also adjustable.

Different types of blades are known and include a single piece blade having a relatively straight front edge that engages the material being moved. Other blades include a single wing at an end of central portion of the blade, or two wings located at either end of a central portion of the blade. In a blade having one or two wings, each wing is either fixed at an inclined angle with respect to the central portion of the blade or is adjustable with respect to the central portion of the blade. In blades having movable wings, the adjustment of the wing reduces the length of the blade. By reducing the length of the blade, the overall width of the vehicle is reduced which can make transport of the vehicle less cumbersome.

Blades with the adjustable wing inclined with respect to the central portion are often used in certain plowing conditions to improve work efficiency. For instance, when the wing is angled with respect to the central portion in a grading operation, wind row spillover is reduced. The wing in the angled position provides a more productive machine by reducing the number of passes needed to complete a grading operation, resulting in more efficient use of the machine.

Grading operations, however, can be adversely affected when using a blade having wings angled with respect to the central portion. Depending on the position of the blade with respect to the surface, the cutting edge of the central portion of the blade may be the only portion of the blade in contact with the surface. In this situation, one or both of wings are not in contact with or cut too deeply into the surface being graded. As a result, additional passes are needed to complete a grading operation. What is needed therefore is a blade having wings and a control system to move a blade with wings to optimize the grading operation of a vehicle's blade.

SUMMARY

In one embodiment, there is provided a method of positioning a blade with respect to a work vehicle having an operator control to position the blade, wherein the blade has an adjustable wing. The method includes: identifying a position of the wing with respect to a central portion of the blade; identifying a blade position based on a blade positioning signal received from the operator control; and automatically adjusting the position of the blade based on the identified position of the wing and the identified blade positioning signal.

In another embodiment, there is provided a work vehicle including a chassis, a blade, and a linkage system connected to the chassis and to the blade, wherein the linkage system is configured to position of the blade with respect to the chassis. The work vehicle further includes an operator control and a controller operatively connected to the operator control and to the linkage system. The controller includes a processor and a memory, wherein the memory is configured to store program instructions. The processor is configured to execute the stored program instructions to: identify a position of the wing with respect to a central portion of the blade; identify a blade position based on a blade positioning signal received from the operator control; and automatically adjust the position of the blade based on the identified position of the wing and the identified blade positioning signal.

In a further embodiment, there is provided a method of moving materials with a blade having an adjustable wing located at one end of a center portion of the blade, wherein the blade is operatively connected to a work vehicle and is positionable with respect to the work vehicle in response to an operator command. The method includes: identifying a commanded position of the blade based on a blade positioning signal received from the operator command; identifying an inclined position of the adjustable wing with respect to the center portion of the blade; automatically adjusting a pitch of the blade with respect to the work vehicle based on the identified commanded position of the blade and the identified inclined position of the adjustable wing.

In a further embodiment of the present disclosure, a blade for a work machine includes a body comprising a main portion including a top edge, a bottom edge, a first lateral edge and a second lateral edge, the first lateral edge being located on an opposite side of the main portion from the second lateral edge; and a wing portion pivotally coupled to the body about a pivot axis, the wing portion being pivotal about the pivot axis between a work position and a transport position; wherein, the first lateral edge comprises a curved edge extending outwardly towards the wing portion, the curved edge forming an apex between the top edge and the bottom edge; wherein, a first axis is defined through a first intersection point and a second intersection point, the first intersection point located at an intersection of the top edge and the first lateral edge and the second intersection point located at an intersection of the bottom edge and the first lateral edge; wherein, a second axis is defined through the apex and is parallel to the first axis; wherein, the pivot axis is located between the first axis and the second axis.

In one example of this embodiment, the pivot axis is located approximately halfway between the first axis and the second axis. In a second example, the pivot axis is located between 25-50% of a distance between the first and second axes. In a third example, in the transport position, the wing is disposed at a maximum angle relative to the main portion; in the work position, the wing is disposed in a first plane and the main portion is disposed in a second plane, the first and second planes being parallel to one another. In a fourth example, the wing portion pivots approximately 55 degrees between the work position and the transport position.

In a fifth example, in the work position, the main portion and the wing portion form a first blade width; in the transport position, the main portion and the wing portion form a second blade width, where the first blade width is greater than the second blade width. In a sixth example, the second blade width is between 20-35 inches less than the first blade width. In a seventh example, the main portion comprises a curved portion defined between the first and second axes, the curved portion at least partially overlapping the wing portion in the work position. In an eighth example, as the wing portion pivots between its work position and transport position, the curved portion remains in close proximity to the wing portion to maintain a minimal gap between the curved portion and the wing portion. In a ninth example, the minimal gap is 5 millimeters or less.

In a further example, in the work position, the wing is disposed in a first plane and the main portion is disposed in a second plane, the first and second planes being parallel to but offset from one another. In yet a further example, the first plane is disposed rearward of the second plane.

In another embodiment of the disclosure, a blade for a work machine includes a body comprising a main portion including a front surface defined by a top edge, a bottom edge, a first lateral edge and a second lateral edge, the first lateral edge being located on an opposite side of the main portion from the second lateral edge; and a wing portion pivotally coupled to the body about a pivot axis, the wing portion being pivotal about the pivot axis between a work position and a transport position; wherein, the front surface comprises a concave curvature in a fore-aft direction; wherein, the pivot axis is located within the concave curvature of the front surface.

In one example of this embodiment, a first vertical axis is defined through a forwardmost point of the front surface; a second vertical axis is defined through a rearmost point of the front surface; the pivot axis is located between the first vertical axis and the second vertical axis. In a second example, the rearmost point is located at an apex of the concave curvature. In a third example, the first lateral edge comprises a curved edge extending outwardly towards the wing portion, the curved edge forming an apex between the top edge and the bottom edge; a first axis is defined through a first intersection point and a second intersection point, the first intersection point located at an intersection of the top edge and the first lateral edge and the second intersection point located at an intersection of the bottom edge and the first lateral edge; wherein, a second axis is defined through the apex and is parallel to the first axis; wherein, the pivot axis is located between the first axis and the second axis.

In a third example, the main portion comprises a curved portion defined between the first and second axes, the curved portion at least partially overlapping the wing portion in the work position. In a fourth example, as the wing portion pivots between its work position and transport position, the curved portion remains in close proximity to the wing portion to maintain a minimal gap between the curved portion and the wing portion. In a fifth example, the minimal gap is 5 millimeters or less. In a sixth example, in the work position, the wing is disposed in a first plane and the main portion is disposed in a second plane, the first and second planes being parallel to but offset from one another. In a seventh example, the first plane is disposed rearward of the second plane.

In yet another embodiment of the present disclosure, a blade for a work machine includes a body comprising a main portion including a front surface defined by a top edge, a bottom edge, a first lateral edge and a second lateral edge, the first lateral edge being located on an opposite side of the main portion from the second lateral edge; and a wing portion pivotally coupled to the body about a pivot axis, the wing portion being pivotal about the pivot axis between a work position and a transport position; wherein, the first lateral edge comprises a curved edge extending outwardly towards the wing portion, the curved edge at least partially overlapping the wing portion in the work position; wherein, the wing portion is rearwardly offset from the front surface.

In one example of this embodiment, the wing portion comprises an inner wing edge, an outer wing edge, a top wing edge, and a bottom wing edge, the inner wing edge located closer to the first lateral edge than the outer wing edge; further wherein, as the wing portion pivots from the work position to the transport position, the inner wing edge moves in a rearward direction as the outer wing edge moves in a forward direction. In a second example, the first lateral edge comprises a curved edge extending outwardly towards the wing portion, the curved edge forming an apex between the top edge and the bottom edge; a first axis is defined through a first intersection point and a second intersection point, the first intersection point located at an intersection of the top edge and the first lateral edge and the second intersection point located at an intersection of the bottom edge and the first lateral edge; wherein, a second axis is defined through the apex and is parallel to the first axis; wherein, the pivot axis is located between the first axis and the second axis.

In a third example, the main portion comprises a curved portion defined between the first and second axes, the curved portion at least partially overlapping the wing portion in the work position. In a fourth example, as the wing portion pivots between its work position and transport position, the curved portion remains in close proximity to the wing portion to maintain a minimal gap between the curved portion and the wing portion. In a fifth example, the front surface comprises a concave curvature in a fore-aft direction; the pivot axis is located within the concave curvature of the front surface. In a sixth example, a first vertical axis is defined through a forwardmost point of the front surface; a second vertical axis is defined through a rearmost point of the front surface; the pivot axis is located between the first vertical axis and the second vertical axis.

In a different example, the rearmost point is located at an apex of the concave curvature. In another example, the wing portion pivots approximately 55 degrees between the work position and the transport position. In a further example, in the work position, the main portion and the wing portion form a first blade width; in the transport position, the main portion and the wing portion form a second blade width, where the first blade width is greater than the second blade width. In yet a further example, the second blade width is at least 25 inches less than the first blade width.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

DETAILED DESCRIPTION

Figure 1:
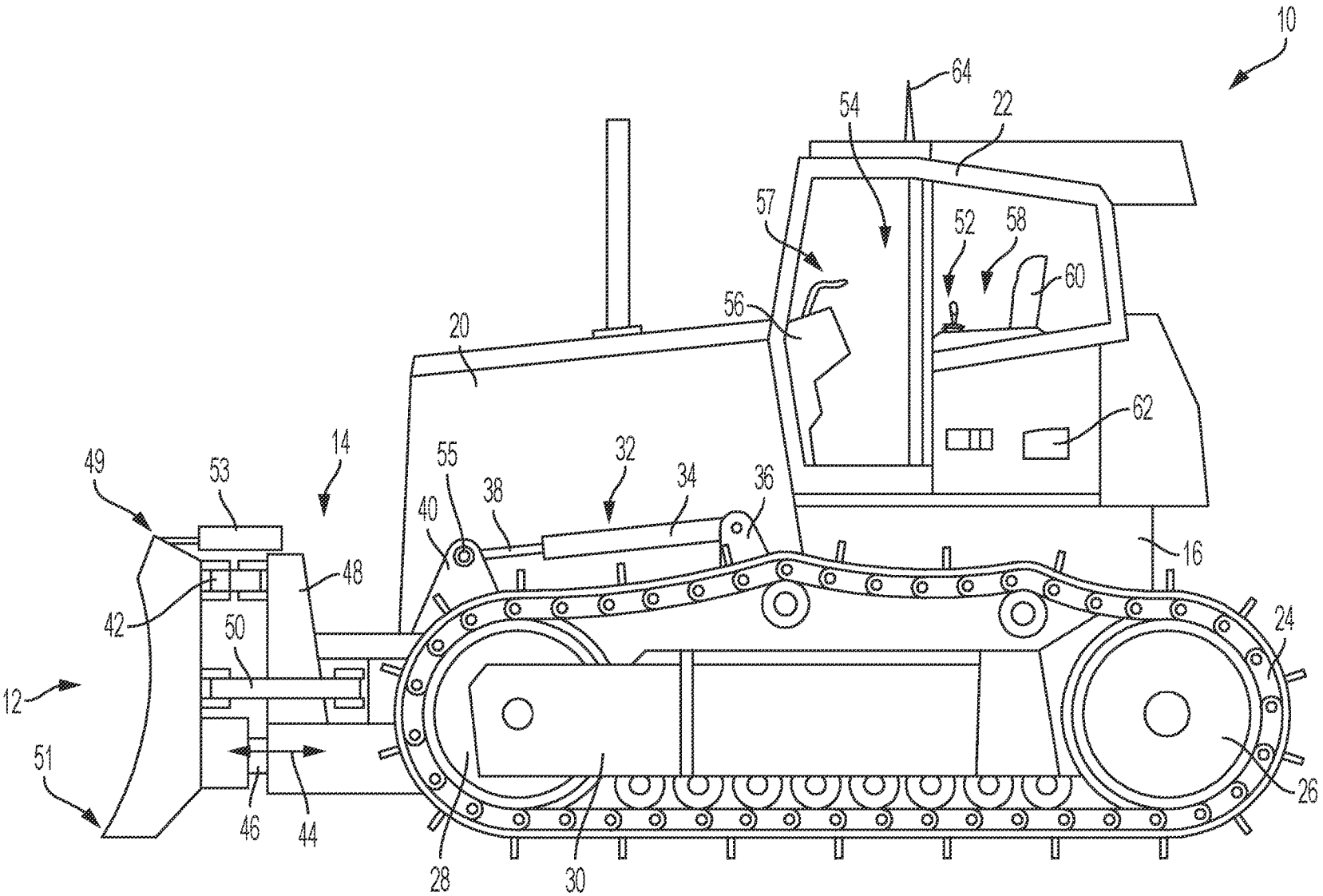
FIG. 1 is an elevational side view of a work vehicle, and more specifically, of a bulldozer such as a crawler dozer including a work implement.

For the purposes of promoting an understanding of the principles of the novel disclosure, reference will now be made to the embodiments described herein and illustrated in the drawings and specific language will be used to describe the same. It will nevertheless be understood that no limitation of the scope of the novel disclosure is thereby intended, such alterations and further modifications in the illustrated devices and methods, and such further applications of the principles of the novel disclosure as illustrated therein being contemplated as would normally occur to one skilled in the art to which the novel disclosure relates.

FIG. 1 is an elevational side view of a work vehicle 10, such as a crawler bulldozer, including an implement, such as a bulldozer blade 12, which is suitably coupled to the dozer by a linkage assembly 14. Other implements, including mold boards, are contemplated. The vehicle includes a frame or chassis 16 which houses an internal combustion engine (not shown) located within a housing 20. The work vehicle 10 includes a cab 22 where an operator sits to operate the vehicle. The vehicle is driven by a belted track 24 which operatively engages a rear main drive wheel 26 and a front auxiliary drive wheel 28. The belted track is tensioned by tension and recoil assembly 30. The belted track is provided with centering guide lugs for guiding the track across the drive wheels, and grousers for frictionally engaging the ground.

While the described embodiments are discussed with reference to a crawler bulldozer, other work vehicles are contemplated including other types of construction vehicles, forestry vehicles, lawn maintenance vehicles, as well as on-road vehicles such as those used to plow snow. Actuators used in one or more of these work vehicles includes tilt, angle, pitch, lift, arm, boom, bucket, blade side shift, blade tilt, and saddle side shift actuators or actuator cylinders. In these and other vehicles, the operator either sits or stands in the cab and has access to operator controls.

The main drive wheels 26 are operatively coupled to a steering system which is in turn coupled to a transmission. The transmission is operatively coupled to the output of the internal combustion engine. The steering system may be of any conventional design and maybe a clutch/brake system, hydrostatic, or differential steer. The transmission may be a power shift transmission having various clutches and brakes that are actuated in response to the operator positioning a shift control lever (not shown) located in the cab 22.

Figure 2:
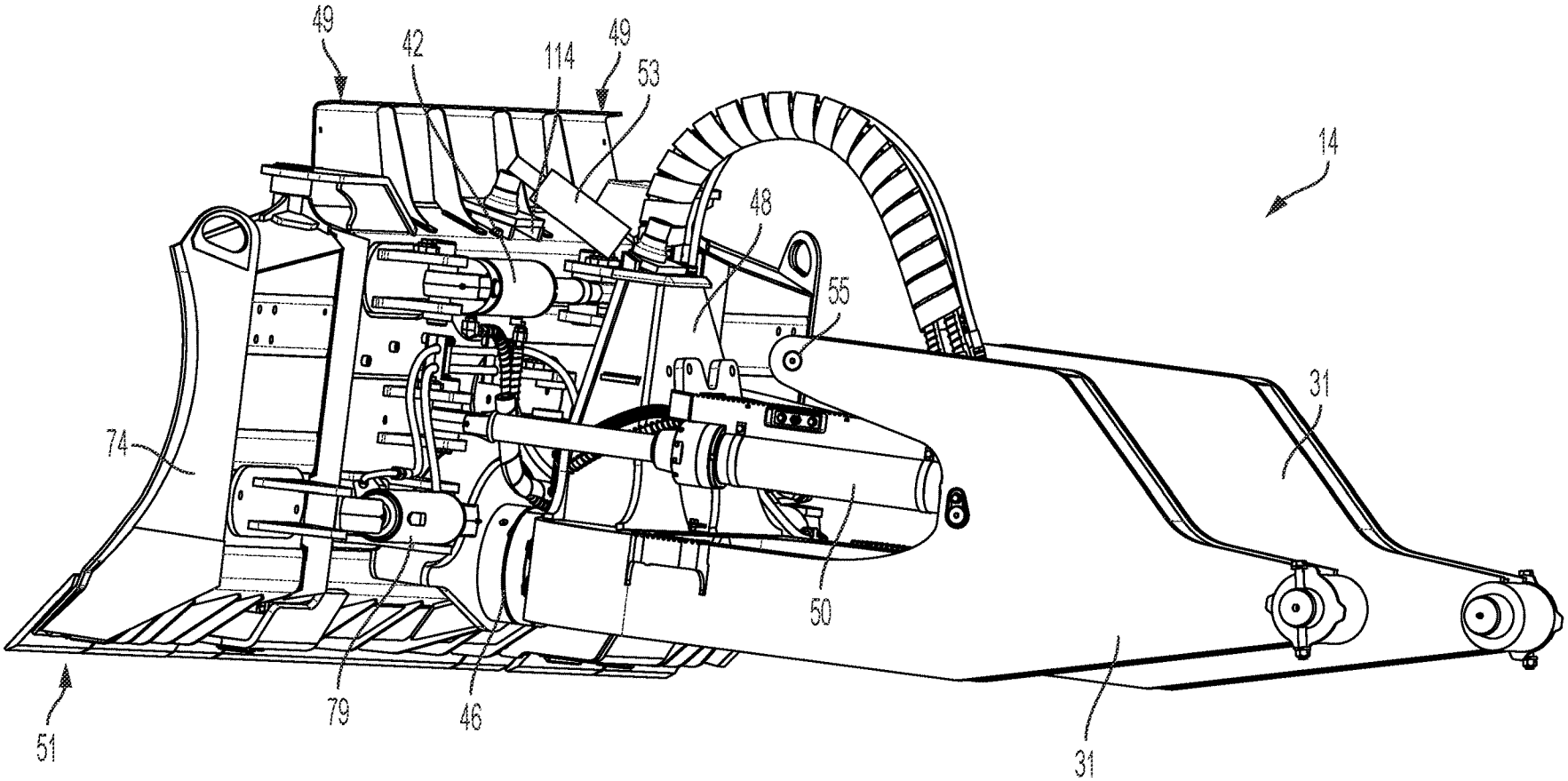
FIG. 2 is a rear perspective view of a work implement, and more particularly a six-way blade, having adjustable wings and associated actuators to move the blade with respect to a work vehicle.

The bulldozer blade 12 (the implement) is raised and lowered by the linkage system 14 which includes a number of actuators, such as hydraulic cylinders, to adjust the position of the blade 12. The linkage system 14 includes a C-frame 31, as seen in FIG. 2 as is understood in the art. The C-frame 31 is raised and lowered with respect to the frame 16 by a lift actuator 32 as shown in FIG. 1. The C-frame in FIG. 1 is generically illustrated. A second lift actuator (not shown) is located on another side of the housing 20. In one embodiment, each of the actuators 32 includes a hydraulic actuator including a body, or cylinder 34, rotatably coupled to the frame 16 at a standoff 36, and an arm 38 that extends and retracts from the cylinder 34. The arm 38 is rotatably coupled to a plate 40 that extends from the C-frame to raise and lower the C-frame and therefore the blade 12. Other configurations of raising and lowering the blade 12 are contemplated including vertically oriented lift cylinders.

The blade 12 is tilted relative to work vehicle 10 by the actuation of a tilt cylinder 42 wherein the blade 12 is rotatable about an axis 44 of a spherical bearing 46. For the tilt cylinder 42, a rod end is pivotally connected to a clevis positioned on the back and left sides of blade 12 above the spherical bearing 46. A head end of the tilt cylinder 42 is pivotally connected to an upward projecting portion 48 that extends from the C-frame 31. The opposite end of the tilt cylinder 42 is coupled to a backside of the blade 12. The positioning of the pivotal connections for the head end and the rod end of tilt cylinder 42 result in tilting blade 12 to the left (counterclockwise) or right (clockwise) when viewed from cab 22. Extension of rod of the tilt cylinder 42 tilts the blade counterclockwise. Retraction of tilt cylinder 42 tilts blade 12 to the right or clockwise when viewed from operator's cab 22. In alternative embodiments, blade 12 is tilted by different mechanisms (e.g., an electrical or hydraulic motor). Tilt cylinder 42, in one or more embodiments, is configured differently, such as a configuration in which cylinder 42 is mounted vertically and positioned on the left or right side of blade 12, or a configuration with two tilt cylinders.

Blade 12 is angled relative to work vehicle 10 by the actuation of angle cylinders 50, one of which is illustrated. For each of angle cylinders 50, the rod end is pivotally connected to a blade 12 while the head end is pivotally connected to frame 31. One of angle cylinders 50 is positioned on the left side of work vehicle 10, and the other angle cylinders 50 is positioned on the right side of work vehicle 10. An extension of the left angle cylinder 50 and the retraction of the right of angle cylinder 50 angles blade 12 rightward such that the right side of the blade 12, as viewed from the cab 22, is pulled closer to the cab. Retraction of left angle cylinder 50 and the extension of the right of angle cylinders 50 angles blade 12 leftward, such that the left side of the blade 12 is pulled closer to the cab 22. In alternative embodiments, blade 12 is angled by a different mechanism or angle cylinders 50 are configured differently.

The blade 12 is pitched with respect to the cab 22 with a pitch cylinder 53 connected to the upward projection portion 48, at one end, and connected to the blade 12 at another end. Extension and retraction of the cylinder 53 moves a top edge 49 of the blade 12 toward or away from the cab 12 to achieve the desired pitch. Pitch of the blade 12 is also provided by raising and lowering the C-frame 31 with the lift cylinders 32 (see FIG. 1) having ends coupled to pivot locations 55. In another embodiment, the pitch cylinder 53 is not included and retraction and extension of the cylinders 50 pitches the blade 12 about the spherical bearing 46.

One or more implement control devices 52, located at a user interface of a workstation 54, are accessible to the operator located in the cab 22. The user workstation includes a front console 56, supporting a grab bar 57 located at a forward portion of the cab 22, and a workstation 58 located at or near the arms of an operator's chair 60. The control devices 52 are operatively connected to a controller 62. The controller 62 receives signals from the control devices 52 to adjust the positon of the blade 12. In other embodiments, the implement control devices are located at the front console 56 or at the front console 56 and the workstation 58.

The control devices 52 are located at a user interface that includes a plurality of operator selectable buttons, switches, joysticks, and toggles configured to enable the operator to control the operations and functions of the vehicle 10. The user interface, in one embodiment, includes a user interface device including a display screen having a plurality of user selectable buttons to select from a plurality of commands or menus, each of which are selectable through a touch screen having a display. In another embodiment, the user interface includes a plurality of mechanical push buttons as well as a touch screen. In still another embodiment, the user interface includes a display screen and only mechanical push buttons. In one or more embodiments, adjustment of blade with respect to the frame is made using one or more levers or joysticks.

Figure 5:
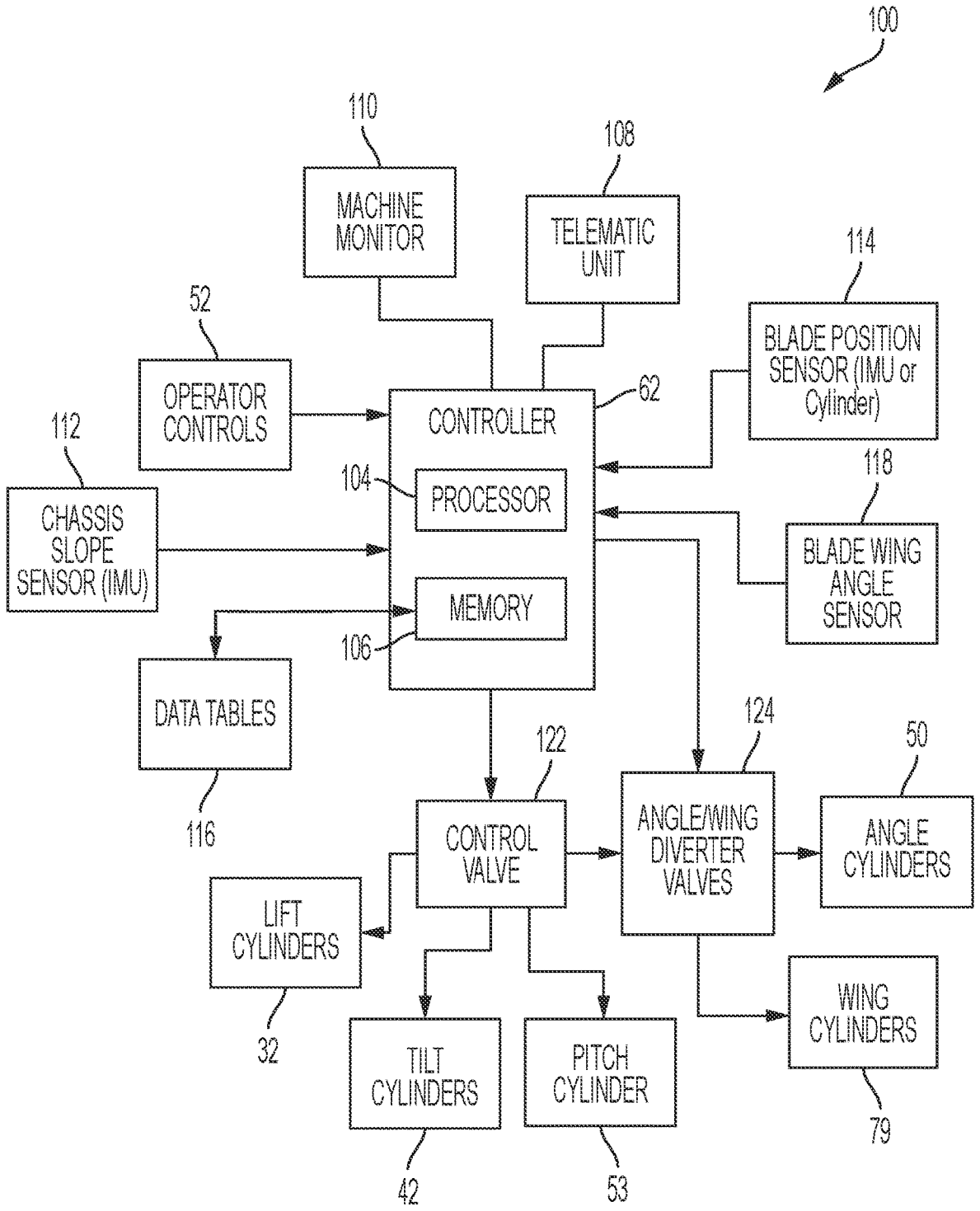
FIG. 5 is a schematic block diagram of a control system configured control the position of an implement, and more particularly to control the position of a blade having adjustable wings.

Adjustment of the actuators 32, 42, and 50 is made by the operator using the control devices 52 which are operably coupled to the controller 62, as seen in FIG. 5, which in one embodiment, is located within the frame 16. Other locations of the controller 62 are contemplated including the cab 22. The control devices 52 are operatively connected to the controller 62 which is operative to adjust the lift cylinders 32, tilt cylinders 42, the angle cylinders 50, and the pitch cylinder 53. Adjustment of one or more of the control devices generates a commanded position received by the controller 62 which identifies to the controller 62 a direction and final position of the blade to achieve a desired grading operation.

In FIG. 1, an antenna 64 is located at a top portion of the cab 22 and is configured to receive and to transmit signals from different types of machine control systems and or machine information systems including a global positioning systems (GPS). While the antenna 64 is illustrated at a top portion of the cab 22, other locations of the antenna 64 are contemplated as is known by those skilled in the art.

Figure 3:
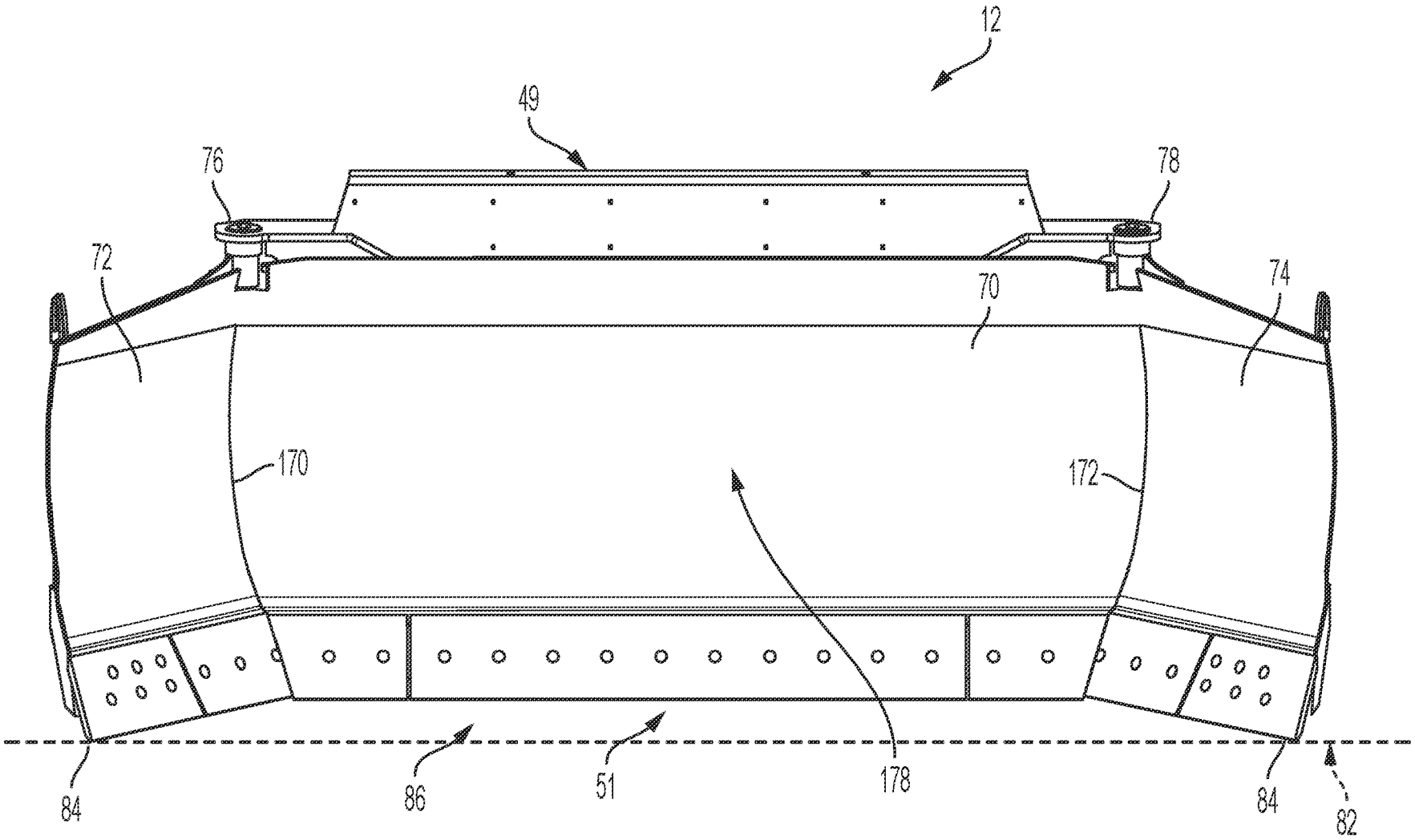
FIG. 3 is a front view of a blade in a forwardly pitched position.
Figure 4:
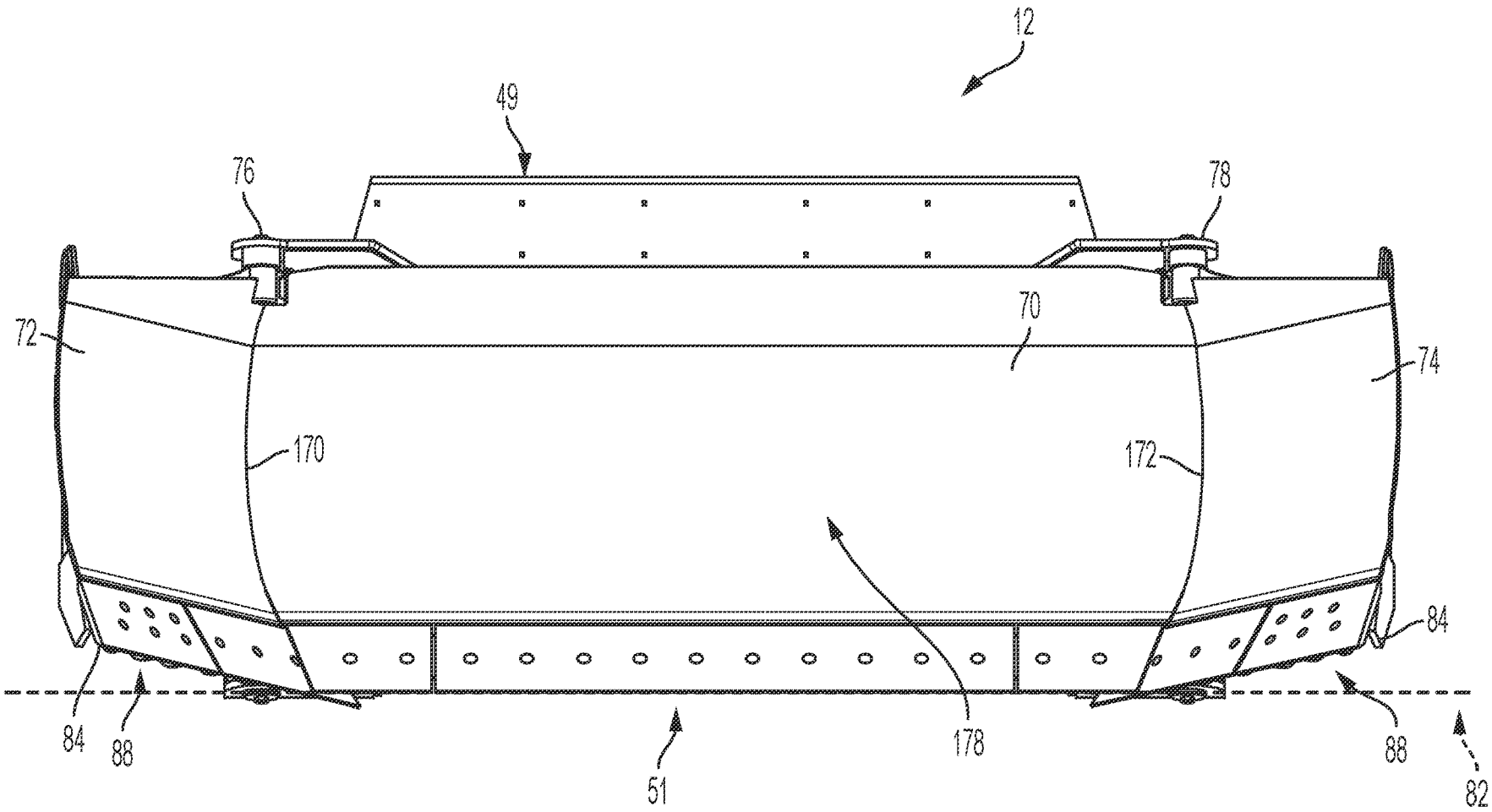
FIG. 4 is a front view of a blade in a rearwardly pitched position.

The blade 12, as illustrated in FIGS. 3 and 4, includes a center portion 70, a first wing 72 rotatably connected to one side of the center portion 70, and a second wing 74 rotatably coupled to another side of the center portion 70. Each of the first and second wings 72 and 74 are respectively rotatably coupled to the center portion 70 at a first hinge 76 and a second hinge 78. Each wing 72 and 74 is adjustably moved by a wing actuator 79 as illustrated in FIG. 2. Each of the FIGS. 3 and 4 illustrate the wings 72 and 74 being folded in or toward a path traveled by the vehicle 10. If each wing 72 and 74 is not folded in but is substantially planar with the center portion 70 as illustrated in FIG. 1, the bottom edge 51 of the entire blade 12 extending from one wing to the other wing is substantially planar with respect to a ground surface 82 and is in contact with the ground surface 82 when lowered sufficiently. If, however, the wings 72 and 74 are folded in, and the pitch of the blade 12 remains the same as illustrated in FIG. 1, the entire edge 51 from wing to wing remains in contact with the ground when lowered.

As illustrated in FIG. 3, should blade 12 be pitched forward, only a leading end point 84 of each wing contacts the ground 82. In this condition, a gap 86 appears between the center portion 70 of the blade and the ground 82, and material to be moved by the blade 12 moves through the gap 86, which reduces the effectiveness of a blade operation. Materials to be moved include dirt, soil, aggregate, snow, and ice to a desired location. Other materials are contemplated.

Also, as illustrated in FIG. 4, if the blade 12 is pitched towards the rear without raising the blade 12, only the bottom edge 51 contacts the ground 82, and the leading end points 84 are raised with respect to the ground 82. In this condition, a gap 88 appears between the end points 84 of the blade and the ground 82. Some of the material to be moved by blade 12 consequently moves through the gaps 88 which reduces the effectiveness of a blade operation.

As illustrated by both FIGS. 3 and 4 the blade contact point to the ground on a straight blade or a blade having wings oriented in the same fashion as a straight blade is a point, when viewed from the side, or a straight edge, when viewed from the front. Even with the blade all the way down at the surface 82 and with the wings 72 and 74 not being inclined with respect to the center blade 70, the edge 51 from wing to wing contacts the ground at the same time. With a folding blade, however, as illustrated in FIGS. 3 and 4, any amount of folding of the wing sections 72 or 74, makes the edge 51 contact the ground 82 in only one pitch position of the blade. When the blade is pitched forward or backward, from a nominal level of FIG. 2, the wings 72 or 72 cutting edges are not contacting the ground on the same level as the wings center portion's cutting edge. For instance, as seen in FIG. 3, the leading edge of the wing's cutting edge is cutting deeper into the ground than the center portion's cutting edge.

To overcome the gaps which are located at the center blade or at the wings, an operator must adjust the pitch of the blade so that the edges of the wings 72 and 74 match the level of the edge of the center portion 70. Because the cutting edges of the blade 12 can be difficult to see by an operator, alignment of the blade 12 with respect to the ground 82 can be very difficult. Such an operation requires extreme concentration, even for an expert operator. In fact, under some conditions where ground conditions and weather conditions are not optimal, correctly placing the blade 12 is next to impossible. Similarly, due to geometry of the ball joint 46 between the blade 12 and the C-frame 31, tilting the blade 12 can affect the pitch of the blade.

To overcome the deficiencies presented by grading a surface with a blade having wings, the present disclosure includes a control system 100 illustrated in FIG. 5, which maintains the positions of the blade 12 with respect to the ground 82 when the wings 72 and 74 are inclined with respect to the center portion 70. By automatically adjusting the position of the blade in response to an operator's control input, the edge of the blade from one wing, to the center portion of the blade, and to the other wing is maintained substantially along a plane identified by the operator control to perform a grading operation.

As seen in FIG. 5, the control system 100 includes the controller 62 which includes a processor 104 and a memory 106. In other embodiments, the controller 62 is a distributed controller having separate individual controllers distributed at different locations on the vehicle 10. In addition, the controller is generally hardwired by electrical wiring or cabling to related components. In other embodiments, however, the controller 62 includes a wireless transmitter and/or receiver to communicate with a controlled or sensing component or device which either provides information to the controller or transmits controller information to controlled devices.

The controller 62, in different embodiments, includes a computer, computer system, or other programmable devices. In other embodiments, the controller 62 includes one or more processors 104 (e.g. microprocessors), and the associated memory 106, which can be internal to the processor or external to the processor. The memory 106 includes, in one or more embodiments, random access memory (RAM) devices comprising the memory storage of the controller 62, as well as any other types of memory, e.g., cache memories, non-volatile or backup memories, programmable memories, or flash memories, and read-only memories. In addition, the memory can include a memory storage physically located elsewhere from the processing devices and can include any cache memory in a processing device, as well as any storage capacity used as a virtual memory, e.g., as stored on a mass storage device or another computer coupled to controller 62. The mass storage device can include a cache or other dataspace which can include databases. Memory storage, in other embodiments, is located in the "cloud", where the memory is located at a distant location which provides the stored information wirelessly to the controller 62.

The controller 62 executes or otherwise relies upon computer software applications, components, programs, objects, modules, or data structures, etc. Software routines resident in the included memory 106 of the controller 62, or other memory, are executed in response to the signals received. The computer software applications, in other embodiments, are located in the cloud. The executed software includes one or more specific applications, components, programs, objects, modules or sequences of instructions typically referred to as "program code". The program code includes one or more instructions located in memory and other storage devices that execute the instructions resident in memory, which are responsive to other instructions generated by the system, or which are provided at a user interface operated by the user. The processor 104 is configured to execute the stored program instructions as well as to access data stored in one or more data tables. A telematic unit 108, or a transmitter and/or receiver, is operatively connected to the antenna 64 to receive and transmit information wirelessly through cellular communication or other types of communication, including satellite.

The processor 104 and the memory 106 are configured to monitor the position of the wings 72 and 74, and when either of the wings 72 or 74 are rotated forward, the controller 62 commands the pitch of the blade 12 to maintain the edge 51 of the blade from wing to wing along a plane. The commanded pitch is based on the currently sensed blade position to keep the leading edge of the wings' cutting edge on the same level of the center portion of the blades cutting edge, thereby, maintaining the grade. When the wings 72 and 74 are articulated at other than parallel with respect to the center portion 70, the controller 62 adjusts the pitch of the blade 12 with respect to ground based on inputs from the operator controls and from the sensor inputs to adjust the pitch the blade, which adjusts the cutting edge of the blade from one wing to the other wing. In different embodiments, each wing 72 or 74 is individually controllable such that the angle of one wing is different than the angle of the other wing.

The vehicle 10 includes a machine monitor 110 which, in different embodiments, includes one or more cameras located on the vehicle, and a visual display screen, located in the cab 22, to display the vehicle, including the vehicle's position with respect to ground, such as direction, slope, and position within a work area being graded. Chassis slope is provided by a chassis slope sensor 112, such as an inertial measurement unit (IMU), which transmits slope signals to the controller 62, which in one or more embodiments, are used by the processor 104 to adjust the blade position. Additional blade information is provided by a blade position sensor 114, which in different embodiments includes an IMU or a cylinder sensor. In one embodiment, a cylinder sensor includes an internal sensor which determines the amount of extension of a cylinder arm from a cylinder body. The resulting signal is received at the processor 104 and used to determine blade position. In one embodiment, one or more data tables 116 include kinematic information, which in combination with the blade position signal received from the sensor 114, determines blade position.

Each of the wings 72 and 74, that is moved by one of the wing cylinders 79, includes a blade wing angle position sensor 118. In one embodiment, the sensor 118 is located at the pivot location about which the wing pivots, such as a rotary angle sensor. In another embodiment, a cylinder sensor determines the extension of the wing cylinder arm from the wing cylinder used to determine wing angle. Other sensors are contemplated.

Each of the lift cylinders 32, the tilt cylinders 42, and the pitch cylinder 53, are coupled to control valves 122 to move the appropriate cylinder as directed by the operator controls 52. Angle/wing diverter valves 124 are operatively connected to the wing cylinders 79 as is understood by one skilled in the art.

The processor 104 receives status and position signals from each of the sensors, the IMUs, or cylinder position sensors, and determines the position of the blade 12 based on those input signals. The memory 106 includes a kinematic model of the blade 12 and the geometry of the C-frame 31. The processor 104 determines, based on the program instructions, when to position the blade, how much to position the blade, and the final location of the blade 12 based the user controls 52 that provide the direction and magnitude of the blade lift, tilt and/or pitch valve commands. Upon determining, these values, the pitch of the blade is adjusted automatically such that each of the cutting edges of the wings 72, 74, and the center blade 70, are located substantially level with the surface being graded. In another embodiment, the wings 72 and 74 are adjusted as well as the blade pitch by commanding positions of wings at the same time as the blade lift/tilt to improve performance and to make a smooth cut without the wing edges cutting into grade or being raised above the grade.

Figure 6:
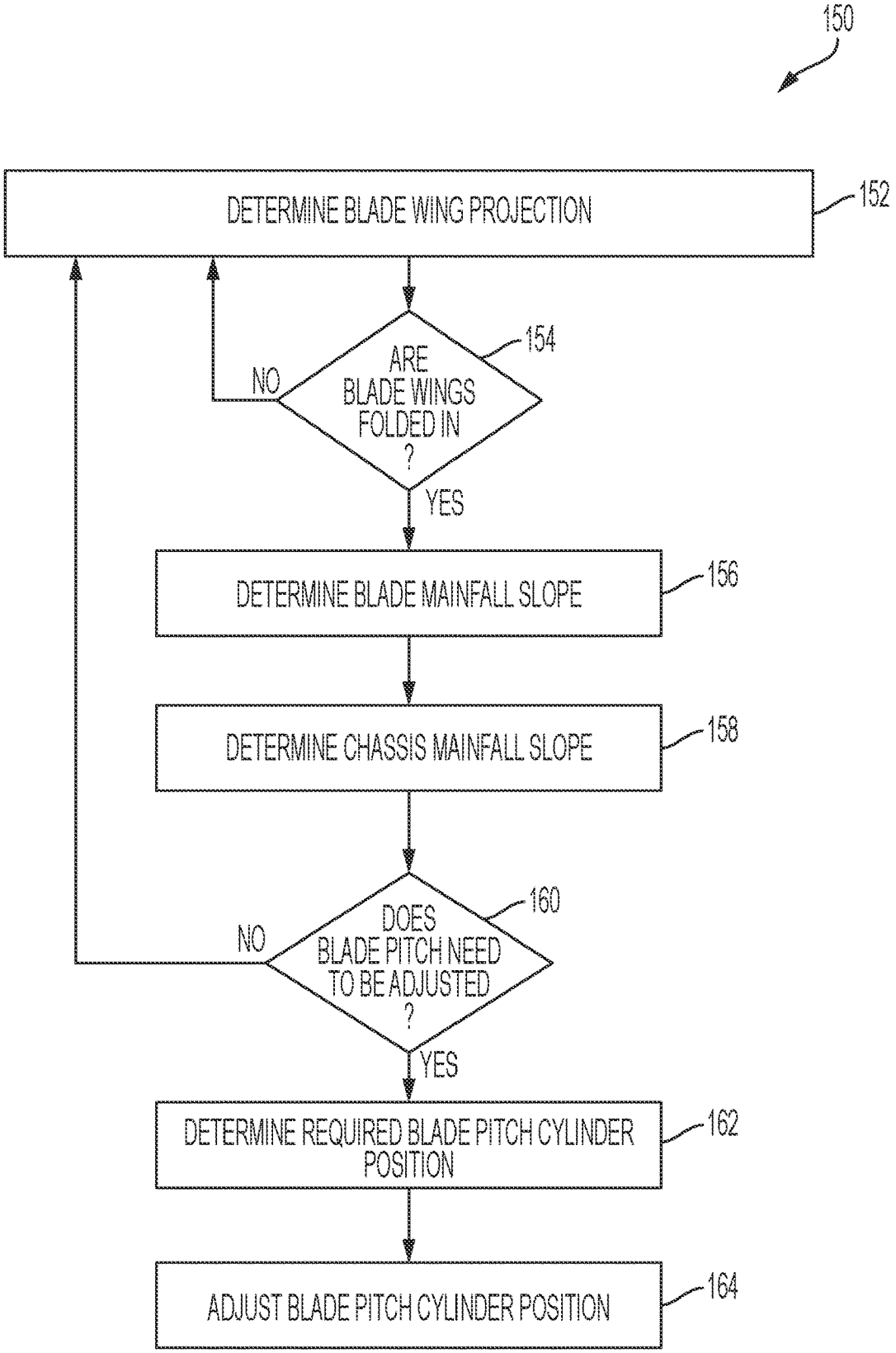
FIG. 6 is a process diagram to automatically adjust a position of a blade based on a position of a wing extending from a central portion of the blade.

FIG. 6 illustrates a block diagram 150 of a process to automatically position the blade 12 based on the position of the wings 72 and 74 in response to an operator's blade command. Initially, at block 152, the controller 62 determines the position of the wings 72 and 74. In one embodiment, the position of each wing 72 and 74 with the center portion 70 is the same. Once the blade wing projection is determined at block 152, the determined value is compared to non-inclined position of the wings to determine if the wings are inclined ("folded in" toward the direction of travel) at block 154. If not, the process returns to block 152 to determine when the wings are folded in. If the wings are folded in at block 154, a blade mainfall slope is identified by the blade position sensor 114 at block 156. The blade mainfall slope identifies the slope of the cutting edge 51 of the central portion of the blade 70. This value of blade mainfall slope is stored in memory 106, or other storage locations. At block 158, a chassis mainfall slope is determined and stored in memory 106. The chassis mainfall slope identifies a slope of the vehicle in the direction of vehicle travel with respect to gravity. Once the values of blade mainfall slope and chassis mainfall slope are determined, the controller 62 determines at block 160 whether the pitch of the blade 12 needs to be adjusted to maintain the blade edge, including the wing edges, at a location being substantially parallel to the surface, and in particular to the intended grade being prepared by the operator using the control devices 52. If the blade pitch should be adjusted as determined at block 160, the controller 62 determines the required blade pitch to achieve the commanded position of the blade 12 at block 162. In one more embodiments the commanded blade signal is modified by the controller 62 to achieve a blade pitch that aligns the edges of the wings and the central portion of the blade with the intended grade. Once the required blade position is determined, the blade pitch is adjusted, when needed, at block 164.

The process of adjusting the blade pitch, based on wing position, is made as the operator moves the blade up or down, adjusts the tilt of the blade, or the angle of the blade. The vehicle control system automatically adjusts the pitch of the blade in response to the operator's commands transmitted by the operator controls, so that the leading edge of the wings' cutting edges are on the same level of the center portion's cutting edge, thereby maintaining grade. The shape of the wings pivot locations 76 and 78 with respect to the main blade assembly 70 together with overlapping protruding curves 170 and 172 of the blade assembly 12 minimizes the gap between ground and the blade in such a way as to restrict material from passing through or beneath the wings or the center portion of the blade. The overlapping protruding curves 170 and 172 are each edges of a metal sheet 178 forming the front surface of the blade 12.

Figure 7:
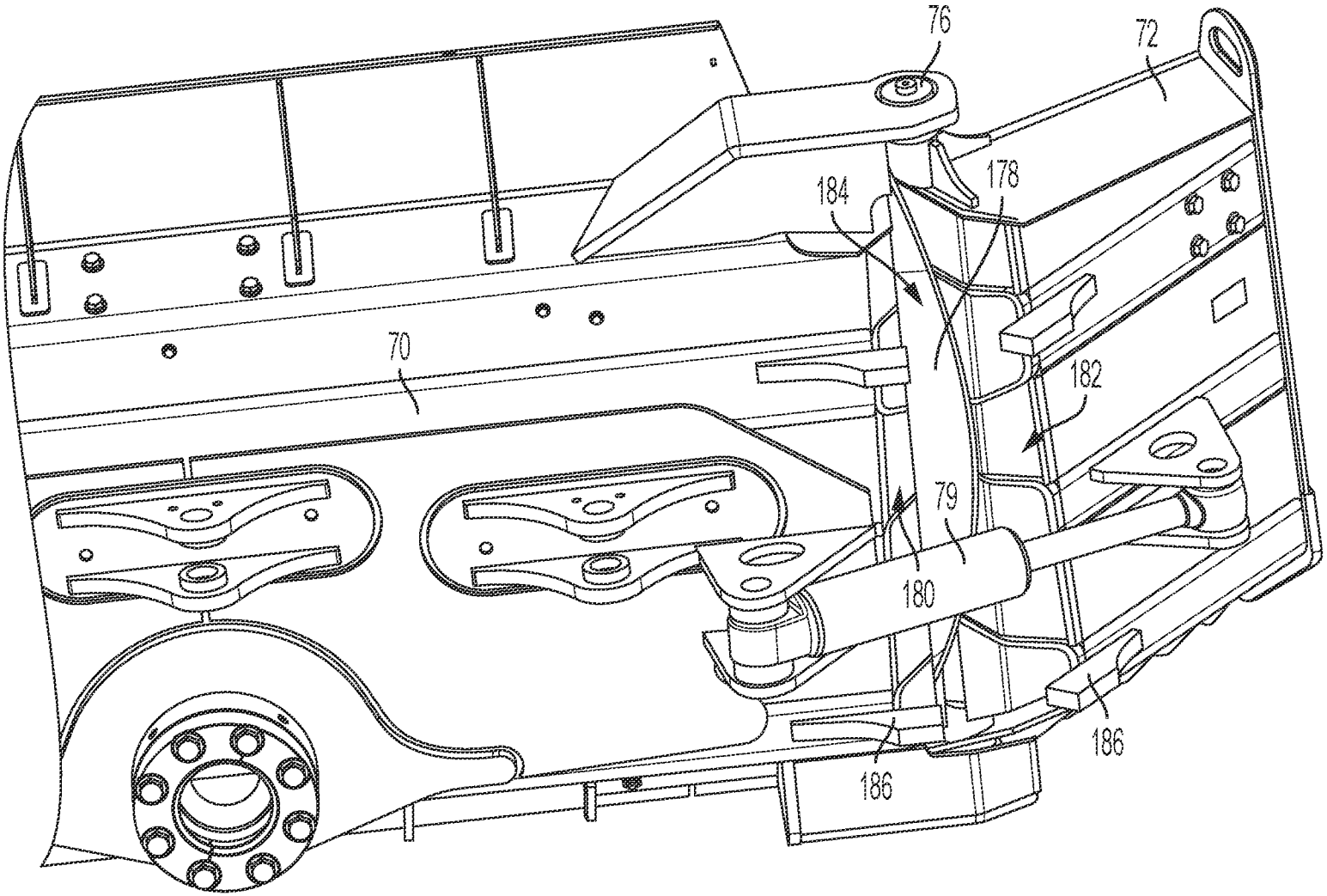
FIG. 7 is a rear view of a blade having a wing located in a forward or folded-in position.

FIG. 7 is a rear view of the blade assembly 12 having wing 72 located in a forward or folded in position. The actuator 79 is extended to incline the wing 72 with respect to the center portion 70 of the blade 12. In this position, a frame 180 of the center portion 70 is spaced from a frame 182 of the wing 72, such that a gap 184 is located between each frame 180 and 182. The gap 184, however, is substantially closed off at the front of the blade 12 by the end of the metal sheet as seen in FIG. 7. See also the front views of FIGS. 3 and 4. When the wings 70 and 72 are planar with the center portion 70, the metal sheet 178 extends over a metal sheet defining the front surface of the wings. When the wings 70 and 72 are inclined, however, the metal sheet 178 covers the gap 184 and substantially prevents material from moving though the gap 184. Because the front surfaces of the middle portion 70 and the wings 72 and 74 are concave, the overlapping ends of the center portion material is not substantially deformed by the inclination of the wings. The blade 12 includes blocking structures 186 to prevent further movement of the wings with respect to the center portion 70 when the wings are not inclined.

Figure 8:
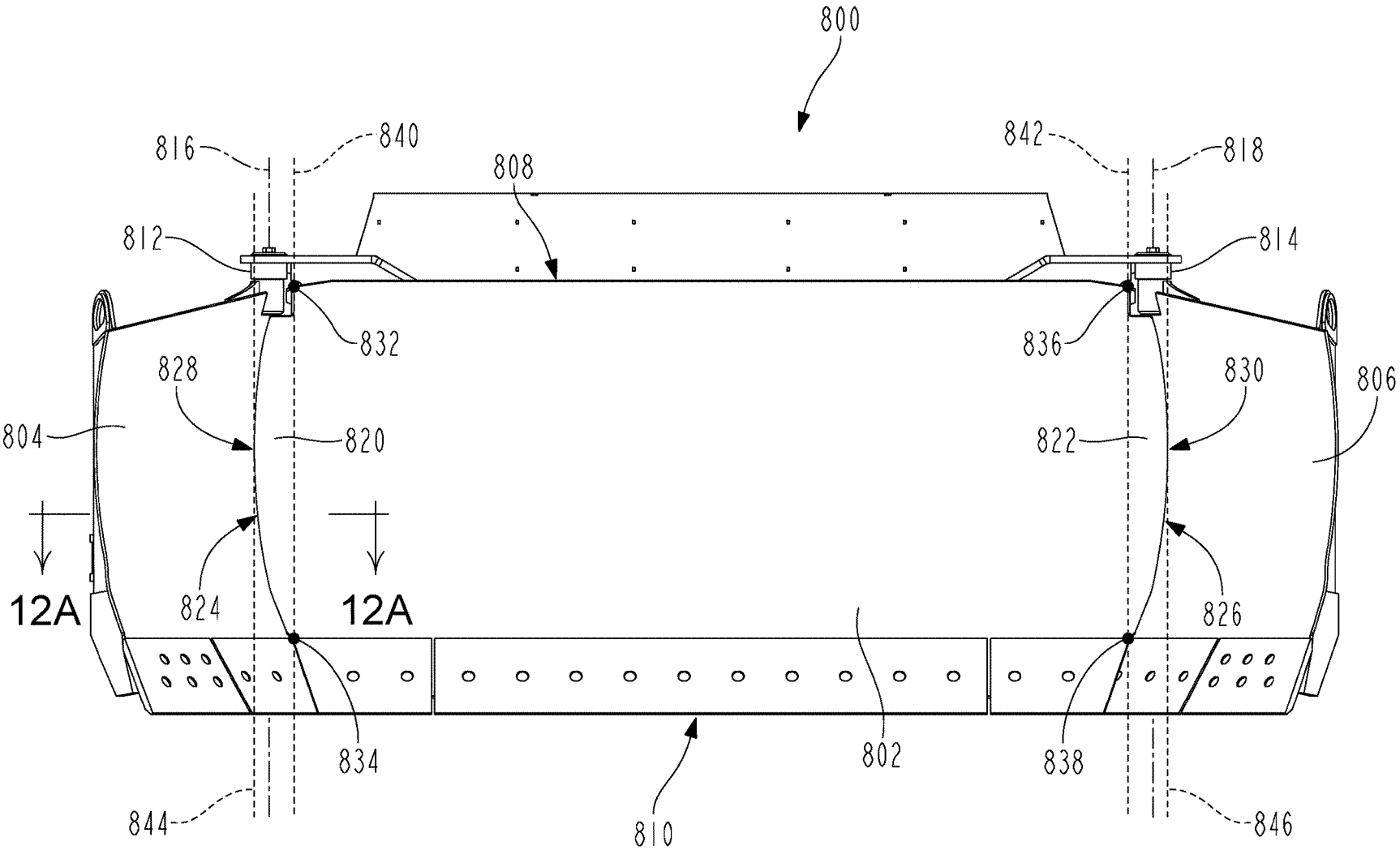
FIG. 8 is a front view of a blade in a rearwardly pitched position.

Referring to FIG. 8 of the present disclosure, another embodiment of a blade 800 is illustrated. In most conventional blades, material such as rock, sand, stone, snow, etc. is often carried in a front portion thereof. Wings, as described above, can be helpful in carrying or pushing the material from one location to another. In the embodiment of FIG. 8, the blade 800 takes on a similar function as a snow plow blade in a snow application but for use in a construction application. The blade 800 is designed with a pair of wings which are pivotal between a folded or transport position and an unfolded or working position. In the unfolded or working position, the blade 800 is capable of having a greater width to increase the carrying and maneuvering capacity during operation. In one non-limiting example, the operating width of the blade 800 in its working position may be greater than 150 inches. In another example, the operating width may be between 150-180 inches. In a further example, the operating width may be between 160-175 inches. In yet a further example, the operating width may be between 165-175 inches. In yet another example, the operating width may be about 172 inches.

In the folded or transport position, the wings may pivot inwardly to reduce the overall width of the blade for ease in transportation. In some cases, governmental regulations may require the blade width to be less than a certain width. In the embodiment of FIG. 8, the transport width of the blade 800 may be less than 150 inches. In another example, the transport width may be between 140-160 inches. In a further example, the transport width may be between 140-150 inches. In yet a further example, the transport width may be between 140-145 inches. In yet another example, the transport width may be about 144 inches.

In FIG. 8, the blade 800 is shown having a center portion 802, a first wing 804 pivotally coupled to one side of the center portion 802, and a second wing 806 pivotally coupled to an opposite side thereof. The center portion 802 may include a top edge 808 and a bottom edge 810. Moreover, the center portion 802 may have a width defined between a first lateral edge 824 and a second lateral edge 826. The first lateral edge 824 may define a curved interface with the first wing 804, and the second lateral edge 826 may define a curved interface with the second wing 806.

The first lateral edge 824 is formed as part of a first overlapping portion 820 of the center portion 802 which partially overlaps the first wing 804. Likewise, the second lateral edge 826 is formed as part of a second overlapping portion 822 of the center portion 802 which partially overlaps the second wing 806. The overlap portions help assist keeping material such as rock or sand from penetrating or flowing inbetween the center portion 802 and each wing. In other words, the lapping portions of the center portion 802 reduces any gap or opening that may otherwise exist between the center portion 802 and each wing.

Each wing is capable of pivoting relative to the center portion 802. In FIG. 8, the first wing 804 is pivotally coupled to the center portion 802 about a first hinge 812. The first hinge 812 defines a first pivot axis 816 about which the first wing 804 pivots relative to the center portion 802. Similarly, the second wing 806 is pivotally coupled to the center portion 802 about a second hinge 814. The second hinge 814 defines a second pivot axis 818 about which the second wing 806 pivots relative to the center portion 802. In one embodiment, the first pivot axis 816 is parallel to the second pivot axis 818, but this is not required in this disclosure. In another embodiment, the pair of pivot axes may not be parallel to one another.

Figure 10:
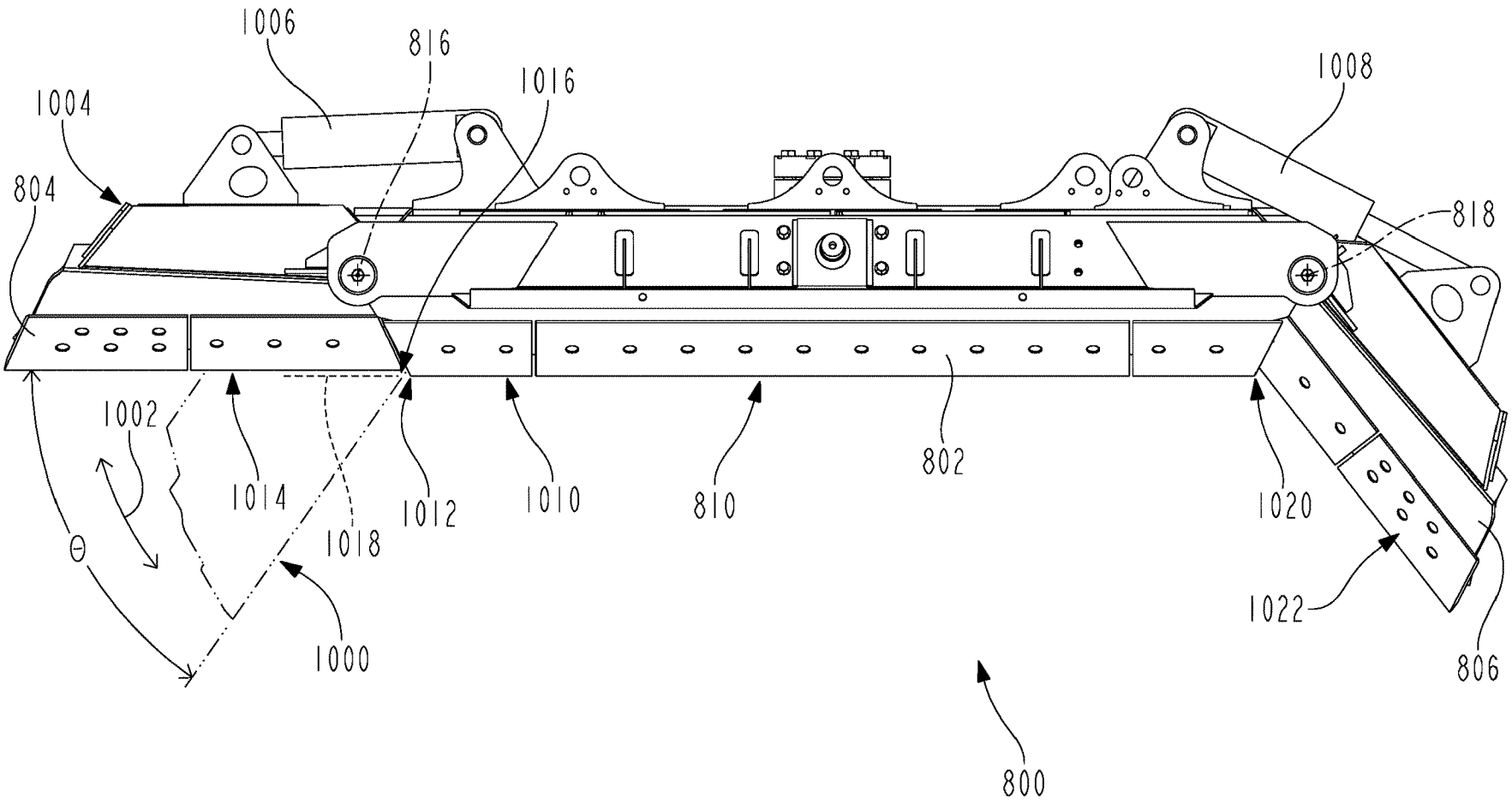
FIG. 10 is a top view of the blade of FIG. 8.

Turning to FIG. 10, for example, the first wing 804 is shown in its transport position 1000 (in broken lines) and its work position 1004 (in solid lines). The angular or pivotal movement of the first wing 804 is thus shown in both positions. For sake of this disclosure, the work position 1004 may be referred to as the first position and the transport position 1000 may be referred to as a second position. In any event, the first wing 804 is capable of traversing an arc-like path 1002 between both positions covering an angle Θ. In one non-limiting example, the pivotal angle Θ may be less than 90°. In another example, the angle Θ may be between 20-75°. In a further example, the angle Θ may be between 30-60°. In yet another example, the angle Θ may be between 45-60°. In yet a further example, the angle Θ may be between 50-60°. In still another example, the angle Θ may be approximately 55°.

In FIG. 10, a first actuator 1006 is capable of actuating the first wing 804 to pivot between its first and second positions. Similarly, a second actuator 1008 is capable of actuating the second wing 806 to pivot about the second pivot axis 818 between its first and second positions.

In the first or working position 1004, the first and second wings are disposed outwardly such that the blade 800 comprises its greatest width. Material may come into contact with the center portion 802 of the blade 800 and move outwardly towards the first and second wings. The amount of material coming into contact with the blade 800 continues to increase as the material flows from the center portion outwardly towards either wing.

Figure 11:
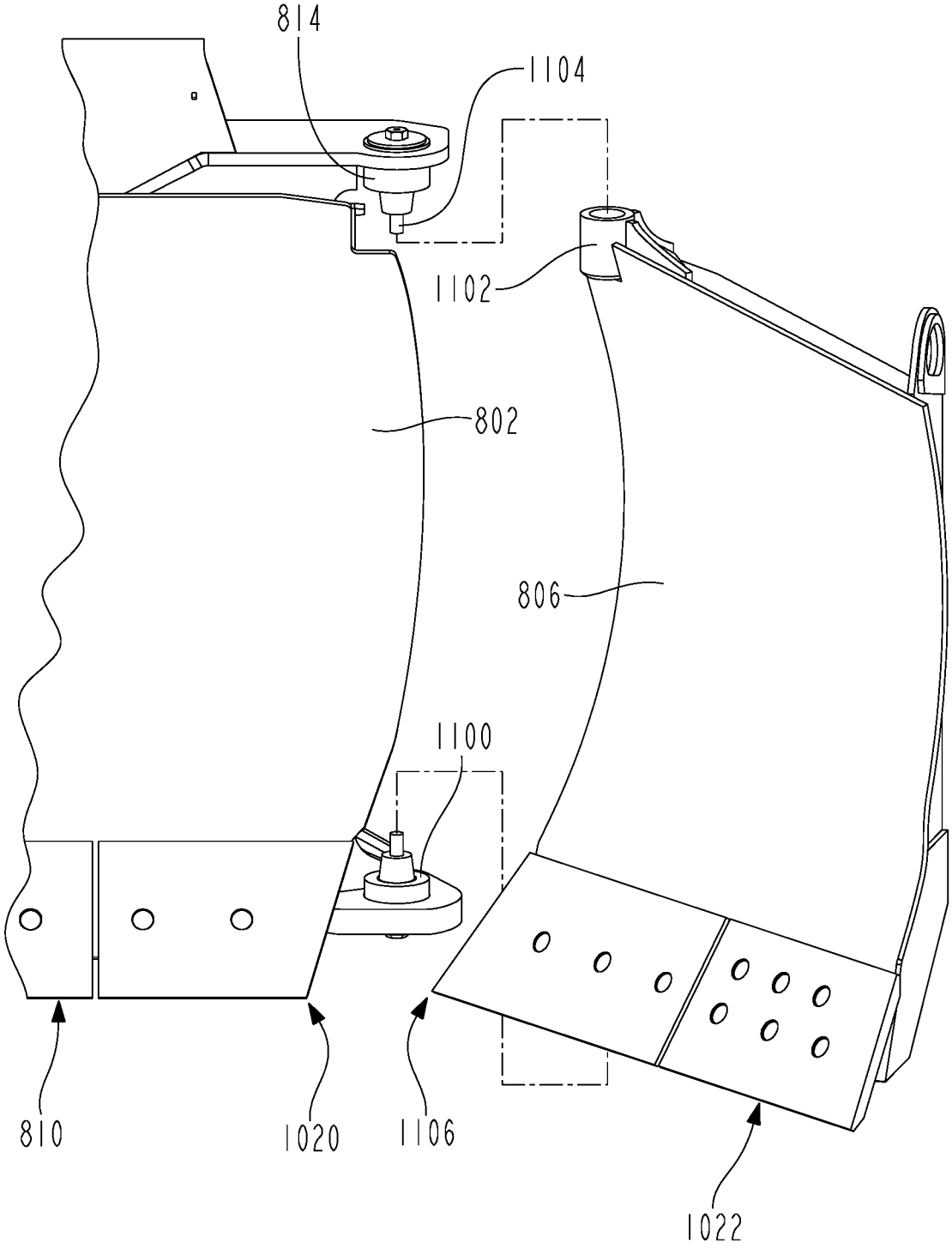
FIG. 11 is a partial perspective view of the blade of FIG. 8 with a wing removed from a center portion.

As best shown in FIG. 11, the second wing 806 is shown relative to the center portion 802 and the second hinge 814. Here, the second hinge 814 includes a pin 1104 that protrudes upwardly and which is configured to engage an opening in a collar 1102 located on the second wing 806. A lower or bottom hinge 1100 may also be provided with a pin that extends in a generally upward orientation and which couples to an opening in the second wing 806 to facilitate the pivotal movement of the second wing 806. A similar hinge is provided on the opposite end of the center portion 802 to which the first wing 804 is coupled.

In this disclosure, a blade is provided with a shape driven by the curved interface between the center portion 802 and both wings which enables the wings to fold relative to the center portion 802 and provide a seal-like function that limits or prevents material from passing therebetween when pivoting between the first and second positions. The embodiment of FIGS. 8-14 is able to achieve this by limiting any rock or other material from getting jammed or lodge between either wing and the center portion. The location of each pivot axis and positioning of the wings relative to the center portion is able to reduce or prevent material from passing between each wing and the center portion.

In FIG. 10, a front view of the blade 800 is shown. The first curved interface or lateral edge 824 includes an arc-like shape. The arc-like shape includes a first apex 828 as shown. Similarly, the second curved interface or lateral edge 826 includes an arc-like shape with a second apex 830. The first apex 828 defines the outer most point of the first lateral edge 824, whereas the second apex 830 defines the outer most point of the second lateral edge 826. Each center portion 802 has its own pronounced curved lateral edges. The location of the apex of the curved lateral edge can provide a first boundary as to the location of the pivot axis. In FIG. 8, for example, a third axis 844 is shown parallel to the first pivot axis 816. The third axis 844 passes through the first apex 828. A fourth axis 846 passes through the second axis 830. The fourth axis 846 is parallel to the second pivot axis 818 as shown.

In FIG. 8, a first axis 840 is shown parallel to the first pivot axis 816 and the third axis 844. The first axis 840 passes through a first upper corner or intersection point 832 and a first lower corner or intersection point 834. The first upper intersection point 832 is defined at an intersection between the top edge 808 and the first lateral edge 824. The first lower intersection point 834 is defined along the first lateral edge 824 such that the first axis 840 is parallel to the third axis 844. In at least one example, the first lower intersection point 834 is defined at the intersection of the first lateral edge 824 and the bottom edge 810. In a different embodiment, the first lower intersection point 834 is not located on the bottom edge 810.

A second axis 842 is shown parallel to the second pivot axis 818 and the fourth axis 846. The second axis 842 passes through a second upper corner or intersection point 836 and a second lower corner or intersection point 838. The second upper intersection point 836 is defined at an intersection between the top edge 808 and the second lateral edge 826. The second lower intersection point 838 is defined along the second lateral edge 826 such that the second axis 842 is parallel to the fourth axis 846. In at least one example, the second lower intersection point 838 is defined at the intersection of the second lateral edge 826 and the bottom edge 810. In a different embodiment, the second lower intersection point 838 is not located on the bottom edge 810.

The first, second, third and fourth axes may establish a region or location of the first and second pivot axes to assist with reducing or preventing material from penetrating between the center portion 802 and each wing. The first pivot axis 816, for example, may be located at any location between the first and third axes. In one example, the first pivot axis 816 may be aligned with the first or third axis. Alternatively, the first pivot axis 816 may be centered between the first and third axes. In another example, the first pivot axis 816 may be disposed closer to the first axis than the third axis. In a further example, the first pivot axis 816 may be positioned closer to the third axis than the first axis. In yet another example, the first pivot axis 816 may be approximately ⅓ of the distance between the first and third axes. Depending on the blade and shape of the first lateral edge 824, the location of the first pivot axis 816 may vary.

Similar to the first pivot axis 816, the second pivot axis 818, for example, may be located at any location between the second and fourth axes. In one example, the second pivot axis 818 may be aligned with the second or fourth axis. Alternatively, the second pivot axis 818 may be centered between the second and fourth axes. In another example, the second pivot axis 818 may be disposed closer to the second axis than the fourth axis. In a further example, the second pivot axis 818 may be positioned closer to the fourth axis than the second axis. In yet another example, the second pivot axis 818 may be approximately ⅓ of the distance between the second and fourth axes. Depending on the blade and shape of the second lateral edge 826, the location of the second pivot axis 818 may vary.

Figure 9:
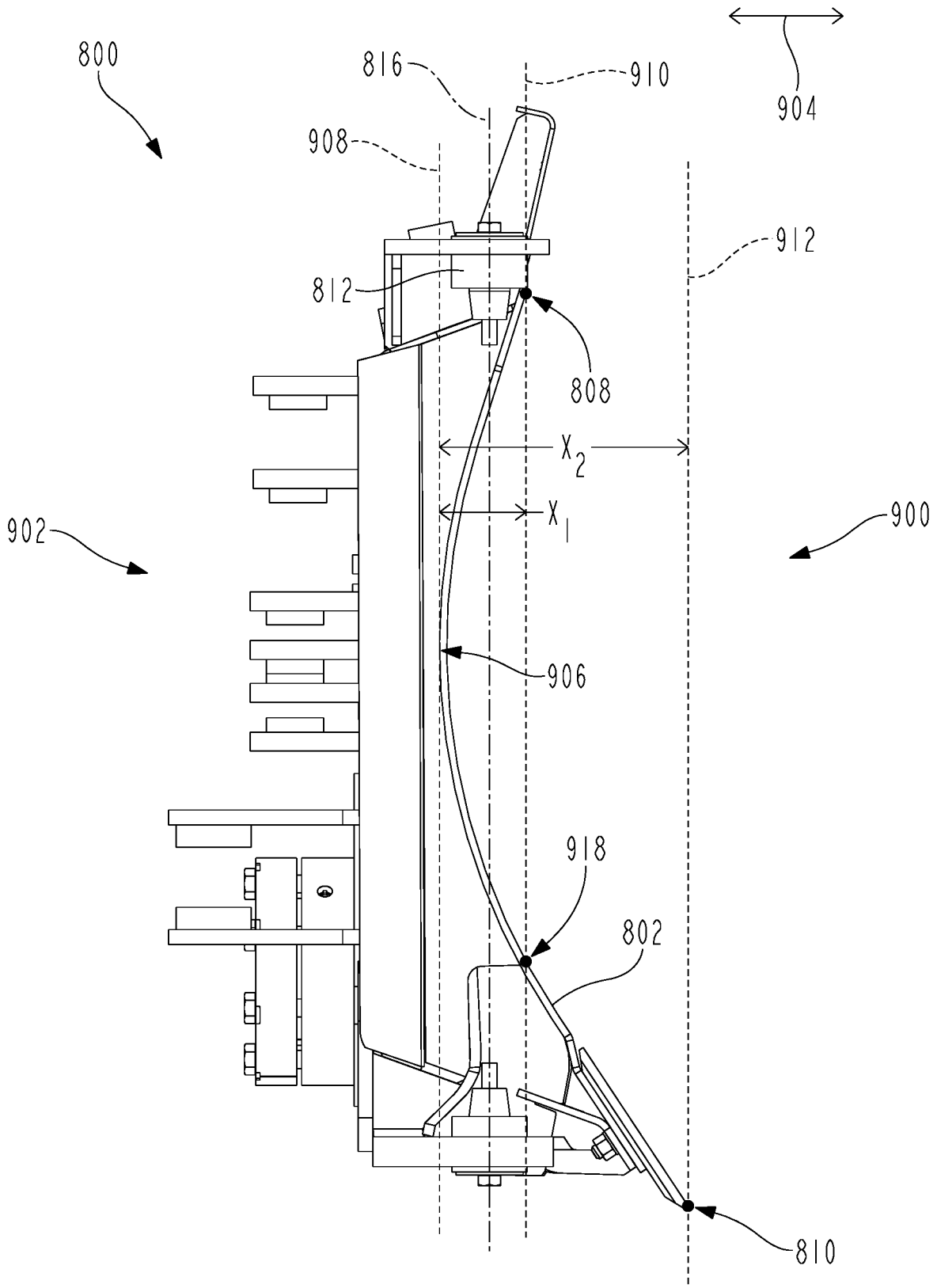
FIG. 9 is a side view of a center portion of the blade of FIG. 8.

Referring to FIG. 9, a side view of the center portion 802 of the blade 800 is illustrated. As shown, the blade 800 has a curvature associated with it rather than being substantially flat like a snow plow blade. The curvature of the blade 800 allows the blade to better cut through material such as dirt, rock, or sand in a construction environment. Moreover, a front side 900 and a rear side 902 of the blade 800 are shown such that the curvature of the blade 800 is best shown in a fore-aft direction 904. In this view, a rearmost point 906 along the blade curvature is shown. This rearmost point 906 corresponds with the surface point of the blade in the furthest rearward location. As shown, a rear axis 908 is defined through the rearmost point 906 of the blade curvature such that the rear axis 908 is substantially parallel to the pivot axis 816.

A front axis 910 is also shown in FIG. 9. The front axis 910 is located forward in the fore-aft direction 904 relative to the rear axis 908. The forward axis 910 intersects a forwardmost point located on the top edge 808 and is substantially parallel to the pivot axis 816. The forward axis 910 further intersects the blade curvature at an intersection point 918. The distance offset between the rear axis 908 and the front axis 910 is defined by an axial distance, $X_1$.

A second forward axis 912 is also shown. In an alternative embodiment, the front axis may correspond with the second forward axis 912 which intersects the forwardmost location along the bottom edge 810 of the blade curvature. In the blade 800 of FIG. 9, the bottom edge 810 is located forward in the fore-aft direction 904 from the top edge 808. Here, the offset distance between the rear axis 908 and the second front axis 912 is defined by an axial distance, $X_2$. As previously noted, different blades comprise different curvatures. Thus, the illustrated blade 800 in FIG. 9 is only one variation of many types of blades that may be used.

In any event, to reduce or prevent any amount of material to pass between the center portion 802 and either wing, the first and second pivot axes may be located between the rear axis 908 and the front axis 910. Alternatively, the pivot axes may be located between the rear axis 908 and the second forward axis 912. In one non-limiting example, either pivot axis may be aligned with the rear axis 908, the front axis 910 or the second front axis 912. In another example, one or both of the pivot axes may be centered between the rear and front axes. In a further example, one or both of the pivot axes may be located closer to the rear axis 908 than the front axis 910. In yet another example, one or both of the pivot axes may be located closer to the front axis 910 than the rear axis 908. In yet a further example, one or both pivot axes may be located closer to the second pivot axis 912 than the rear axis 908. Regardless of its exact location, each pivot axis is located within the cutting edge of the blade 800 and rearmost blade surface in the fore-aft direction 904.

The location of each pivot axis also facilitates the folding or pivoting motion of the wing relative to the respective hinge and center portion 802. Referring to FIG. 10 again, the positioning of the wings relative to the center portion 802 enables a sweeping action of the wings while maintaining a tight profile. Here, the first wing 804 is shown in its work position 1004. In this position, a forwardmost surface 1010 of the center portion 802 is shown relative to a forwardmost surface 1014 of the first wing 804. As shown, the forwardmost surface 1014 of the first wing 804 is offset behind or rearward of the center portion 802. This is perhaps best seen with respect to a first corner 1012 of the center portion 802 which is aligned along a center plane 1018. A first wing corner 1016 is also shown, but it is located rearward of the center plane 1018. Depending on the thickness of the cutting edge, the wing forwardmost surface 1014 may be less than 10 mm rearward of the center plane 1018. In another example, the wing forwardmost surface 1014 may be less than 5 mm rearward of the center plane 1018. In a further example, the wing forwardmost surface 1014 may be less than 3 mm rearward of the center plane 1018. In yet another example, the wing forwardmost surface 1014 may be between 2-3 mm rearward of the center plane 1018.

As described previously, during a grading operation, the heaviest portion of material such as dirt, rock, or sand generally contacts the center portion 802 of the blade 800 and then transitions laterally outwardly towards the wings. If the wings were located forward of the center portion 802, the material would easily pass inbetween the center portion 802 and each wing. However, in the design of FIG. 10 of the present disclosure, each wing is offset rearwardly of the center portion 802 and thus the material tends to continue flowing outwardly along the wing surface.

Even with the center portion 802 located forward of the wings, there is still a small gap therebetween. The aforementioned first overlapping portion 820 and second overlapping portion 822 assist with minimizing the gap and reducing or preventing material from reaching the gap. In addition to the positioning of the wings rearward of the center portion 802 of the blade 800, the pivotal motion or movement of the wings further reduces the size of the gap and prevents material from jamming between the wing and center portion 802. Moreover, during a grading operation, a wider gap may cause irregularities in the grading performance and therefore it is desirable to minimize the gap to reduce or prevent these irregularities. This is shown best in FIGS. 10 and 12. Here, the path taken by the wing during its pivotal movement between the first and second positions can be both translational as well as pivotal.

As shown in FIG. 10, the second wing 806 is disposed in the second or transport position 1000. To get to this position, the innermost lower corner of the wing 1106 (FIG. 11) translates rearwardly further behind a second corner or edge 1020 of the center portion 802. This occurs as the second wing 806 is pivoted about the second pivot axis 818 via the second actuator 1008. The second wing 806 includes a forwardmost surface 1022 as shown in FIG. 10.

Figure 12A:
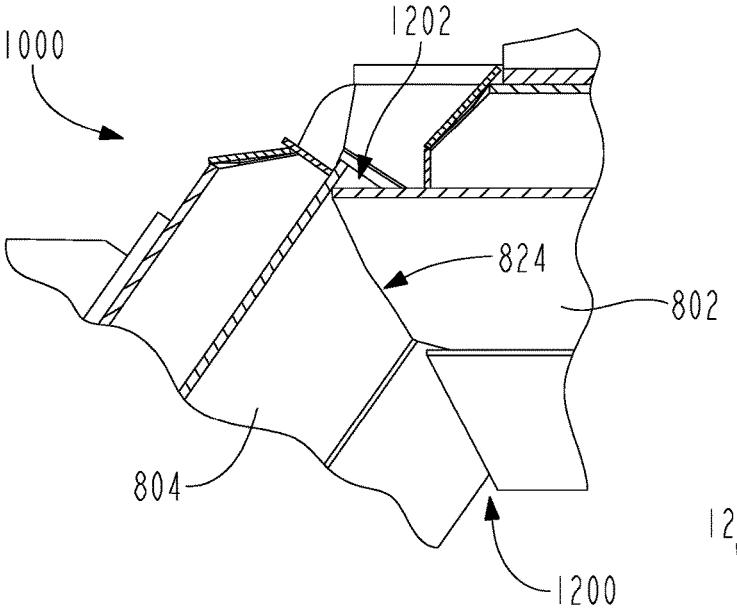
FIG. 12A-C are partial cross-sectional views of the wing taken along line 12-12 in FIG. 8 in different pivotal positions relative to the center portion of the blade.

Referring to FIG. 12A, the first blade 804 is shown in its second position 1000. A gap 1200 is shown most pronounced near the bottom edge 810 of the blade 800, and the gap 1200 is defined between the center portion 802 and first wing 804. In this position, a lateral edge 1202 of the wing 804 is located behind the center portion 802. The lateral edge 1202 of the wing may be angled relative to the pivot axis such that it, along with the curved lateral edge 824 of the center portion 802, produces a tight, closed profile when moving through the sweeping pivotal motion. In effect, this further maximizes blade efficiency in preventing material from seeping into the gap 1200.

Figure 12B:
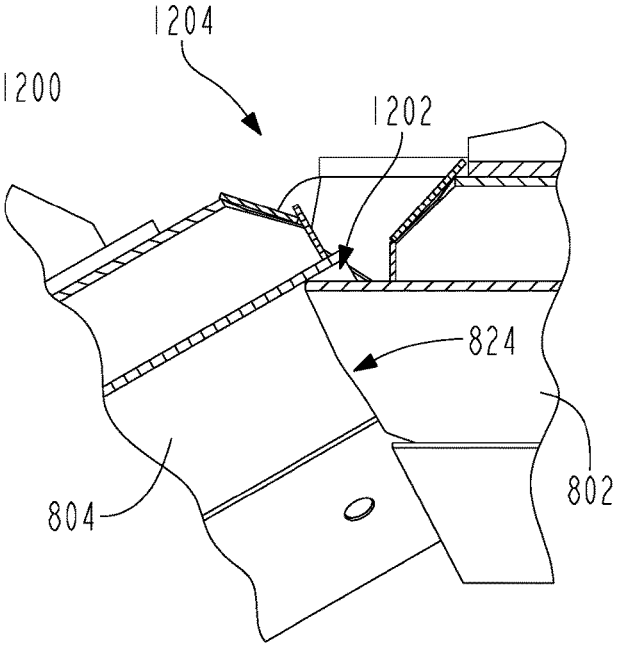

In FIG. 12B, the first wing 804 is shown in an intermediate pivotal position located between the first and second positions. Here, the first wing 804 is pivoting from the second position to the first position. As it does, the lateral edge 1202 of the wing 804 moves closer to the lateral edge 824 of the center portion 802. The profile between the center portion 802 and first wing 804 remains tight to reduce or prevent material from leaking through the gap 1200.

Figure 12C:
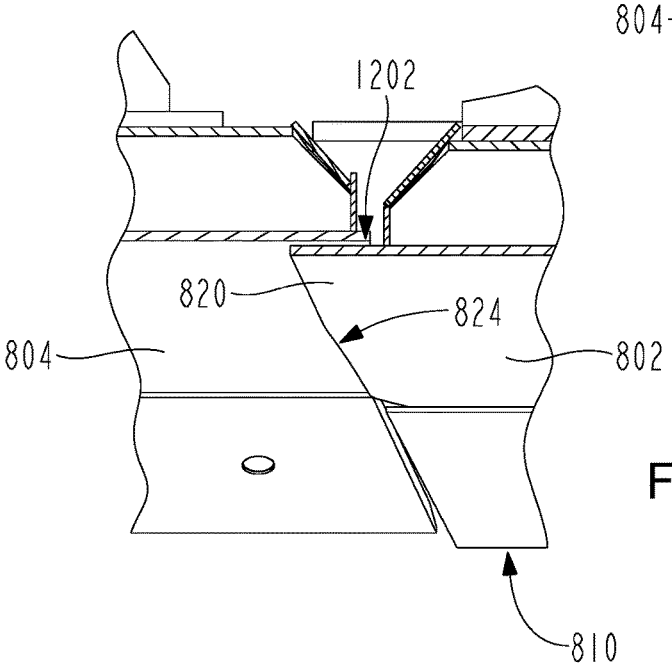

Lastly, in FIG. 12C, the first wing 804 is in its first, working position 1004 whereby the first overlapping portion 824 of the center portion 802 partially overlaps a front surface of the wing 804. As shown in FIG. 12C, the first wing 804 is located rearward of the center portion 802.

In essence, the geometry of the center portion 802 (e.g., its curved lateral edges) and wings (angled edges) as well as positioning of the wing rearward of the center portion 802 enables the wing to move translationally and pivotally with respect to the center portion 802.

It is also noteworthy that locating the wing rearward of the center portion better enables a mechanical advantage of utilizing an end stop, which is described above.

Figure 13:
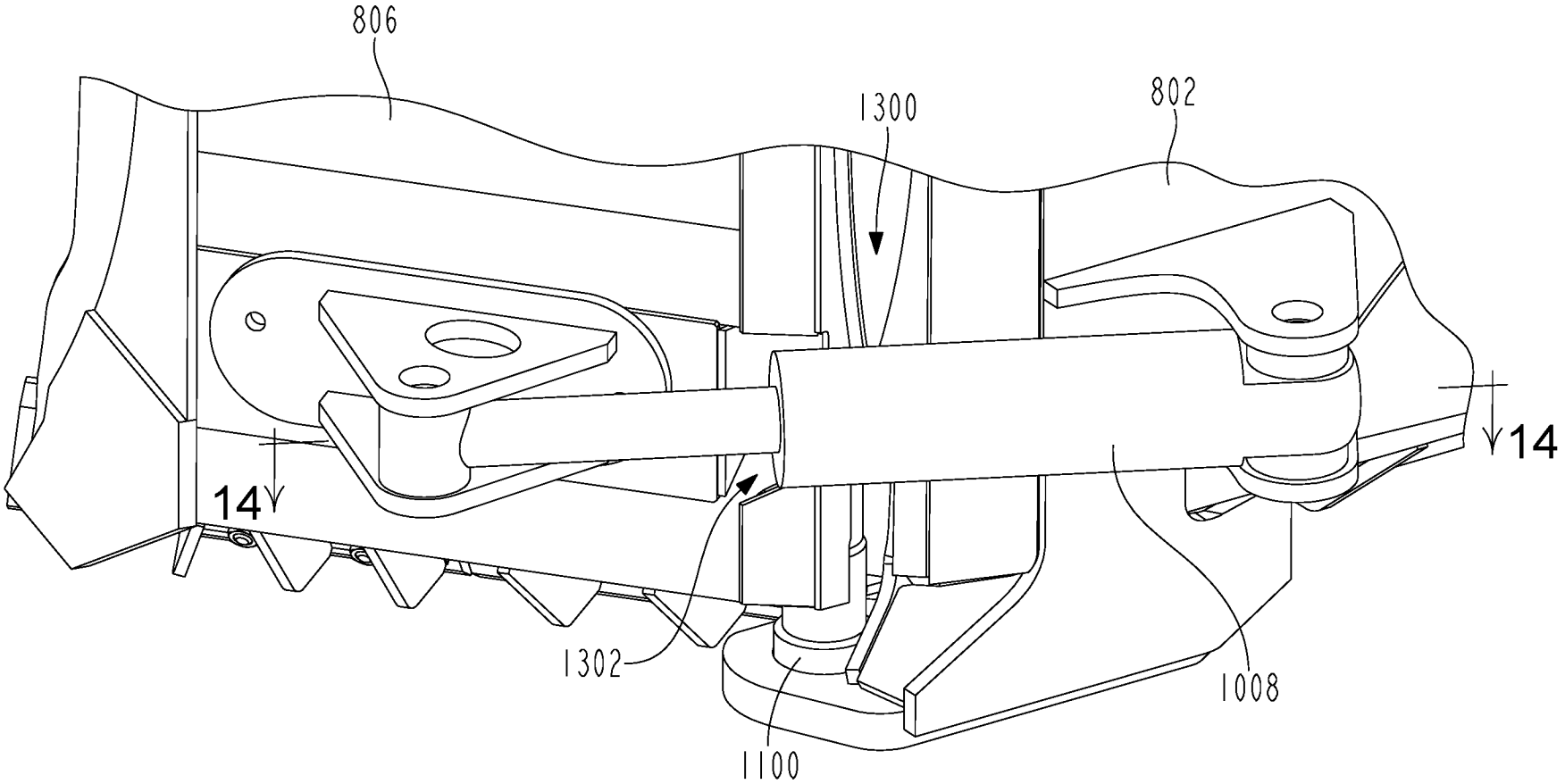
FIG. 13 is a partial rear perspective view of the blade of FIG. 8.
Figure 14:
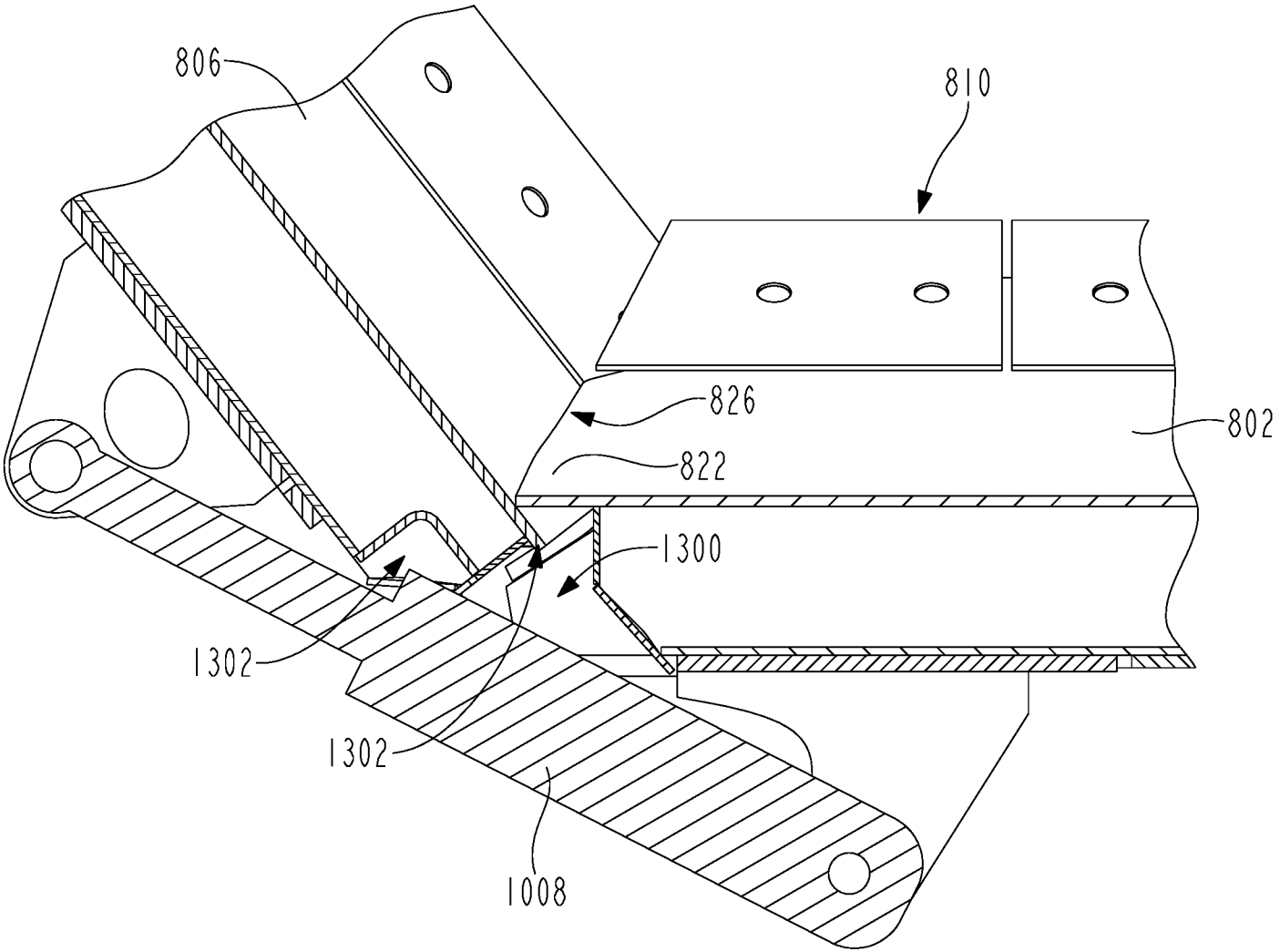
FIG. 14 is a partial cross-sectional view of the blade of FIG. 8 taken along line 14-14 in FIG. 13.

Turning to FIGS. 13 and 14 of the present disclosure, a portion of the rear side 902 of the blade 800 is shown. In this embodiment, the blade 800 may include one or more pockets, spaces, or cavities free of any structure. In FIG. 13, for example, a first pocket 1300 is shown above the actuator 1008. The location of the first pocket 1300 may enable the actuator to extend further thereby allowing additional pivotal movement of the wing 806 relative to the center portion 802. A second pocket 1302 is also shown which also enables the actuator 1008 to extend and retract without interference with the wing 806 or center portion 802.

While exemplary embodiments incorporating the principles of the present disclosure have been described hereinabove, the present disclosure is not limited to the described embodiments. Instead, this application is intended to cover any variations, uses, or adaptations of the disclosure using its general principles. In addition, while the terms greater than and less than have been used in making comparison, it is understood that either of the less than or greater than determines can include the determination of being equal to a value. Further, this application is intended to cover such departures from the present disclosure as come within known or customary practice in the art to which this disclosure pertains and which fall within the limits of the appended claims.

The invention claimed is:

1. A blade for a work machine, comprising:

a body comprising a main portion including a front surface defined by a top edge, a bottom edge, a first lateral edge and a second lateral edge, the first lateral edge being located on an opposite side of the main portion from the second lateral edge; and a wing portion pivotally coupled to the body about a pivot axis, the wing portion being pivotal about the pivot axis between a work position and a transport position;

wherein, the first lateral edge comprises a curved edge extending outwardly towards the wing portion, the curved edge forming an apex between the top edge and the bottom edge;

wherein, a first axis is defined through a first intersection point and a second intersection point, the first intersection point located at an intersection of the top edge and the first lateral edge and the second intersection point located at an intersection of the bottom edge and the first lateral edge;

wherein, a second axis is defined through the apex and is parallel to the first axis;

wherein, the pivot axis is located between the first axis and the second axis and the pivot axis is parallel to the first axis;

wherein, the front surface comprises a concave curvature in a fore-aft direction;

wherein, the pivot axis is located within the concave curvature of the front surface.

2. The blade of claim 1, wherein:

a first vertical axis is defined through a forwardmost point of the front surface;

a second vertical axis is defined through a rearmost point of the front surface;

the pivot axis is located between the first vertical axis and the second vertical axis.

3. The blade of claim 2, wherein the rearmost point is located at an apex of the concave curvature.

4. The blade of claim 1, wherein the main portion comprises a curved portion defined between the first and second axes, the curved portion at least partially overlapping the wing portion in the work position.

5. The blade of claim 4, wherein as the wing portion pivots between its work position and transport position, the curved portion remains in close proximity to the wing portion to maintain a minimal gap between the curved portion and the wing portion.

6. The blade of claim 5, wherein the minimal gap is 5 millimeters or less.

7. The blade of claim 1, wherein in the work position, the wing portion is disposed in a first plane and the main portion is disposed in a second plane, the first and second planes being parallel to but offset from one another.

8. The blade of claim 7, wherein the first plane is disposed rearward of the second plane.

9. A blade for a work machine, comprising:

a body comprising a main portion including a front surface defined by a top edge, a bottom edge, a first lateral edge and a second lateral edge, the first lateral edge being located on an opposite side of the main portion from the second lateral edge, the top edge of the body defining a first horizontal axis; and a wing portion including a front surface defined by a top edge, a bottom edge, a first lateral edge, and a second lateral edge, the first lateral edge being located on an opposite side of the wing portion from the second lateral edge, the top edge of the wing portion defining a second horizontal axis;

wherein, the wing portion is pivotally coupled to the body about a pivot axis, the wing portion being pivotal about the pivot axis between a work position and a transport position;

wherein, in the work position, the second horizontal axis is parallel to and rearward of the first horizontal axis, and when the blade moves from the work position to the transport position, the wing portion pivots inwardly towards the body while the body remains in the same position as in the work position;

wherein, the first lateral edge comprises a curved edge extending outwardly towards the wing portion, the curved edge at least partially overlapping the wing portion in the work position;

wherein, the wing portion is rearwardly offset from the front surface.

10. The blade of claim 9, wherein the wing portion comprises an inner wing edge, an outer wing edge, a top wing edge, and a bottom wing edge, the inner wing edge located closer to the first lateral edge than the outer wing edge;

further wherein, as the wing portion pivots from the work position to the transport position, the inner wing edge moves in a rearward direction as the outer wing edge moves in a forward direction.

11. The blade of claim 9, wherein:

the first lateral edge comprises a curved edge extending outwardly towards the wing portion, the curved edge forming an apex between the top edge and the bottom edge;

a first axis is defined through a first intersection point and a second intersection point, the first intersection point located at an intersection of the top edge and the first lateral edge and the second intersection point located at an intersection of the bottom edge and the first lateral edge;

wherein, a second axis is defined through the apex and is parallel to the first axis;

wherein, the pivot axis is located between the first axis and the second axis.

12. The blade of claim 11, wherein the main portion comprises a curved portion defined between the first and second axes, the curved portion at least partially overlapping the wing portion in the work position.

13. The blade of claim 12, wherein as the wing portion pivots between its work position and transport position, the curved portion remains in close proximity to the wing portion to maintain a minimal gap between the curved portion and the wing portion.

14. The blade of claim 9, wherein:

the front surface comprises a concave curvature in a fore-aft direction;

the pivot axis is located within the concave curvature of the front surface.

15. The blade of claim 14, wherein:

a first vertical axis is defined through a forwardmost point of the front surface;

a second vertical axis is defined through a rearmost point of the front surface;

the pivot axis is located between the first vertical axis and the second vertical axis.

16. The blade of claim 15, wherein the rearmost point is located at an apex of the concave curvature.

17. The blade of claim 9, wherein the wing portion pivots approximately 55 degrees between the work position and the transport position.

18. The blade of claim 9, wherein:

in the work position, the main portion and the wing portion form a first blade width;

in the transport position, the main portion and the wing portion form a second blade width, where the first blade width is greater than the second blade width.

19. The blade of claim 18, wherein the second blade width is at least 25 inches less than the first blade width.

* * * * *